US011172746B2

(12) United States Patent
Maceo

(10) Patent No.: US 11,172,746 B2
(45) Date of Patent: Nov. 16, 2021

(54) RAZOR CADDY ASSEMBLY

(71) Applicant: Julio Maceo, Miami, FL (US)

(72) Inventor: Julio Maceo, Miami, FL (US)

( * ) Notice: Subject to any disclaimer, the term of this patent is extended or adjusted under 35 U.S.C. 154(b) by 56 days.

(21) Appl. No.: 16/459,423

(22) Filed: Jul. 1, 2019

(65) Prior Publication Data

US 2020/0000199 A1 Jan. 2, 2020

Related U.S. Application Data

(60) Provisional application No. 62/692,686, filed on Jun. 30, 2018.

(51) Int. Cl.
*A45D 27/22* (2006.01)

(52) U.S. Cl.
CPC ..... *A45D 27/22* (2013.01)

(58) Field of Classification Search
CPC ..... A45D 27/22; B26B 21/44; B26B 21/52; B65D 83/14
USPC ..... 206/208, 352
See application file for complete search history.

(56) References Cited

U.S. PATENT DOCUMENTS 1,908,797 A * 5/1933 Svalland ..... A47B 49/004 312/305
3,141,712 A * 7/1964 Holmes ..... A47K 1/09 312/206
3,782,799 A * 1/1974 Hansen ..... A47K 1/09 312/206
4,875,593 A * 10/1989 Trimble ..... A47K 3/281 211/95
5,007,533 A * 4/1991 Purohit ..... A45D 27/22 206/352
7,858,027 B2 * 12/2010 Trissei ..... A45D 27/46 206/352
9,339,151 B2 * 5/2016 Yang ..... A47K 3/281
9,943,192 B2 * 4/2018 Yang ..... F16B 7/105

FOREIGN PATENT DOCUMENTS

EP 0764504 A1 * 3/1997 ..... B26B 21/52

* cited by examiner

*Primary Examiner* — Bryon P Gehman

(74) *Attorney, Agent, or Firm* — Jacob Ong; Ongs Law Firm, PLLC

(57) ABSTRACT

A razor caddy assembly may have an inner housing disposed within an outer housing; a plate may be coupled to the inner housing; a holster may be disposed onto the plate and within an opening of the inner housing. The holster may be tiltable along an axle. A user may rotate the outer housing so as to expose the holster of the inner housing, the razor rack of the inner housing, and the blade holder of the and shaving accessories that may be stored on the inner housing; the user may remove a shaving can that is disposed on the holster, a razor that is disposed on a razor rack, and a blade that is disposed on a blade rack.

19 Claims, 37 Drawing Sheets

RAZOR CADDY ASSEMBLY

BACKGROUND OF THE INVENTION

1. The Field of the Invention

The present invention relates to devices and methods for storing razors and razor accessories.

2. Background

Many people shave often, whether it be facial hair, leg hair, or other types of hair. A need exists for storing the razor and accessories in a device that allows for quick access, while at the same time being aesthetically pleasing.

BRIEF DESCRIPTION OF THE DRAWINGS

The preferred embodiments of the present invention will be described in conjunction with the appended drawings. Like designations denote like elements, and.

DETAILED DESCRIPTION

Figure 1A:
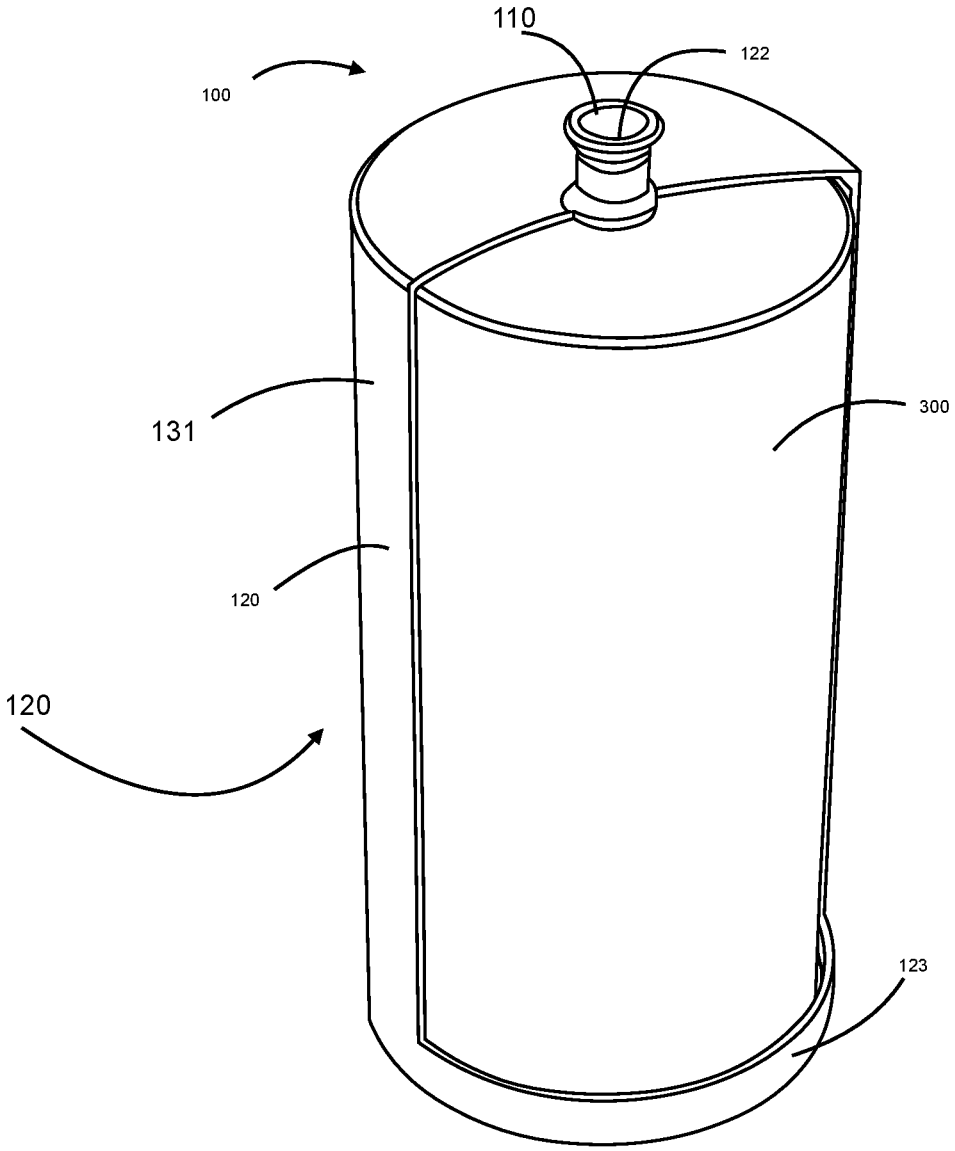
FIG. 1*a* shows a perspective view from the back side of an embodiment of a razor caddy assembly; for purposes of this application, the "left side" is located on to the right of the razor caddy assembly.
Figure 1B:
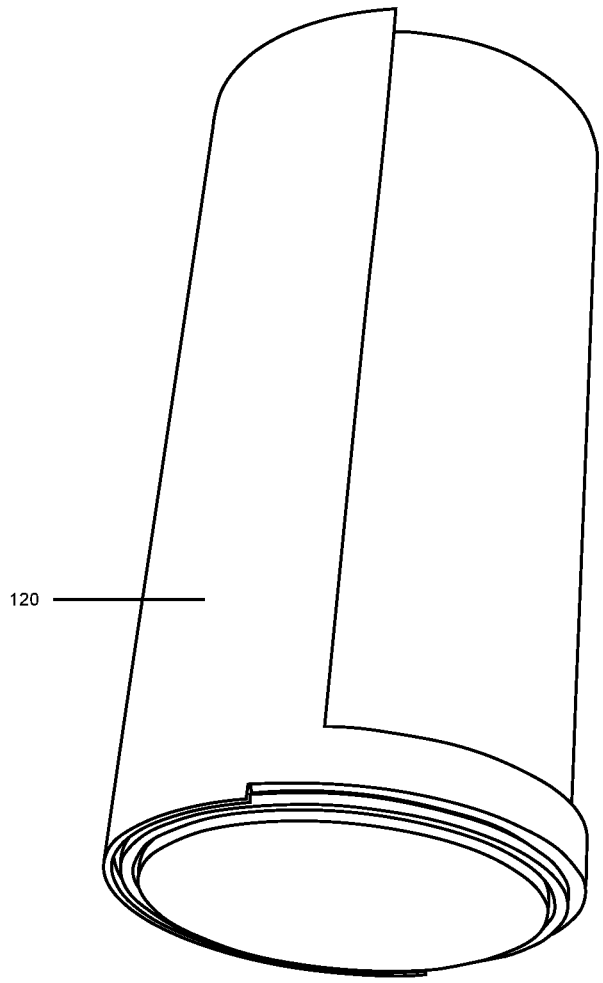
FIG. 1*b* shows the razor caddy assembly of FIG. 1*a*; the embodiment of the razor caddy assembly has been rotated clockwise so that the right side of the razor caddy assembly is viewable; the razor caddy assembly has also been tilted so that the bottom side is viewable.
Figure 1C:
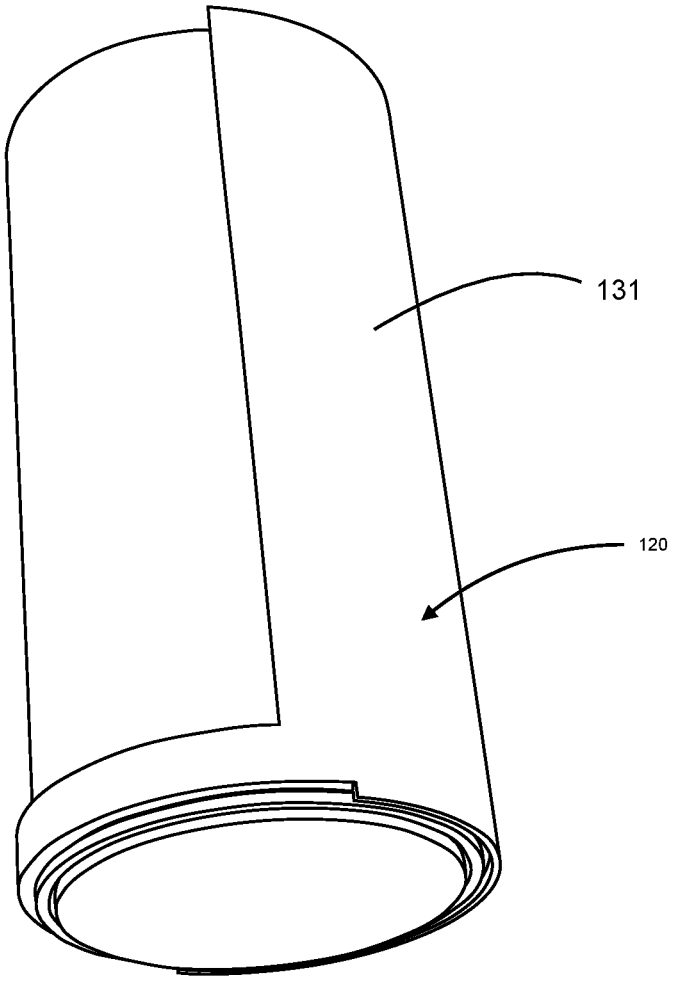
FIG. 1*c* shows the left side of the embodiment of the razor caddy assembly that is shown in FIG. 1*b;*
Figure 1D:
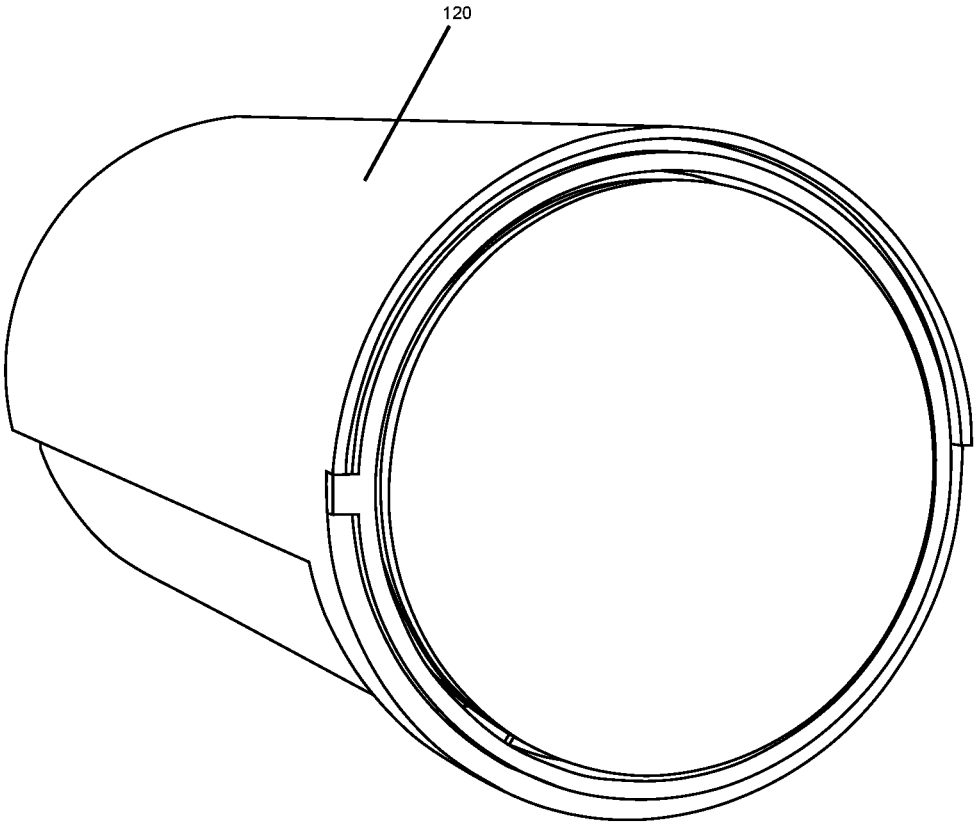
FIG. 1*d* shows a perspective view of the bottom side of an embodiment of the razor caddy assembly.
Figure 1E:
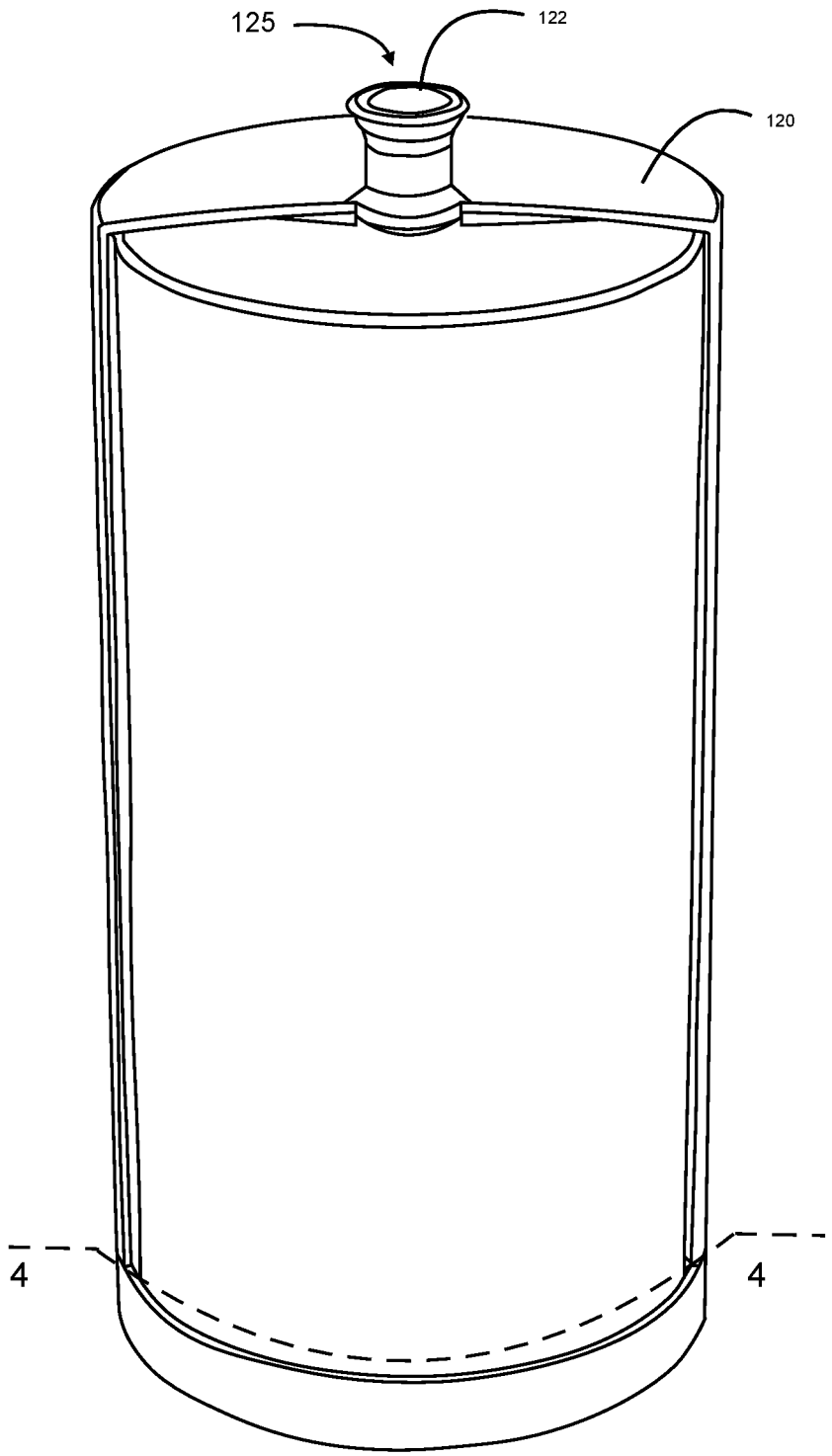
FIG. 1*e* shows a back view of an embodiment of the razor caddy assembly; the dotted line from 4 to 4 shows the plane upon which the sectional view of FIG. 3 was taken; the razor caddy assembly having been rotated 180 degrees.

It will be readily understood that the components of the present invention, as generally described with reference to the drawings herein, could be implemented in a wide variety of different configurations. Thus, the following more detailed description of the embodiments of the system and method of the present invention, is not intended to limit the scope of the invention but is merely representative of various embodiments of the invention. Unless it is explicitly stated, the use of "or" means and/or, that is, this the non-exclusive meaning of or.

The outer housing and the inner housing may both have a main wall that are each flanked and defined by a generally semi-circular bottom edge and a generally semi-circular top edge. The width of any component may be between 0.1 inch and 30 inches; the outer housing and inner housing may have a height between 8 inches and 12 inches. The main wall 131 of the outer housing 120 and the main wall 328 of the inner housing may each be a half-cylinder-shaped shell.

The inner housing may be positioned with respect to the outer housing such that the inner housing and outer housing may be coupled; the point at which the outer housing is coupled to the inner housing may be located substantially at a lower portion of the inner housing. When the outer housing is in a closed position, then the outer housing may obscure or substantially obscure from view the inner wall of the inner housing.

Referring to FIG. 1*a*, a razor caddy assembly 100 may have an outer housing 120, that may be annular in at least one portion; the outer portion 120 may have a knob 122; the outer housing 120 may be coupled via a knob fastener 110 (see FIG. 2) to the outer housing 120; FIG. 1*a* depicts an embodiment of a head of a knob fastener 110; the knob fastener 110 may also be coupled to the outer housing 120 via the knob fastener 110; the outer housing 120 may have an outer housing connector 130; the outer housing connector 130 as shown in FIG. 5*g* is a circular rail that may be disposed on the interior surface of the outer housing 120. In the preferred embodiments, the outer housing 120 is generally shaped like a cylinder in which a portion of a top face and a portion of a side face have been removed; the top face is where the knob may be located; the top face may be shaped like half of a circle; in the preferred embodiment the top face is generally shaped like a crescent.

Figure 5A:
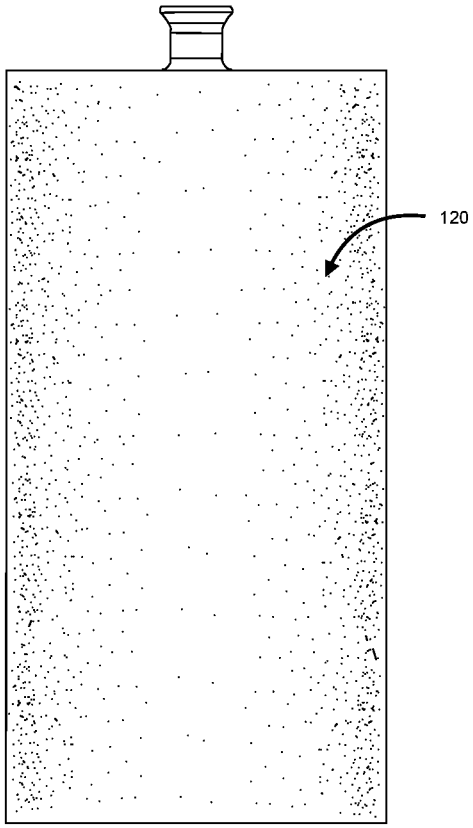
FIG. 5*a* shows the front side of an embodiment of an outer housing of an embodiment of a razor caddy assembly.
Figure 5B:
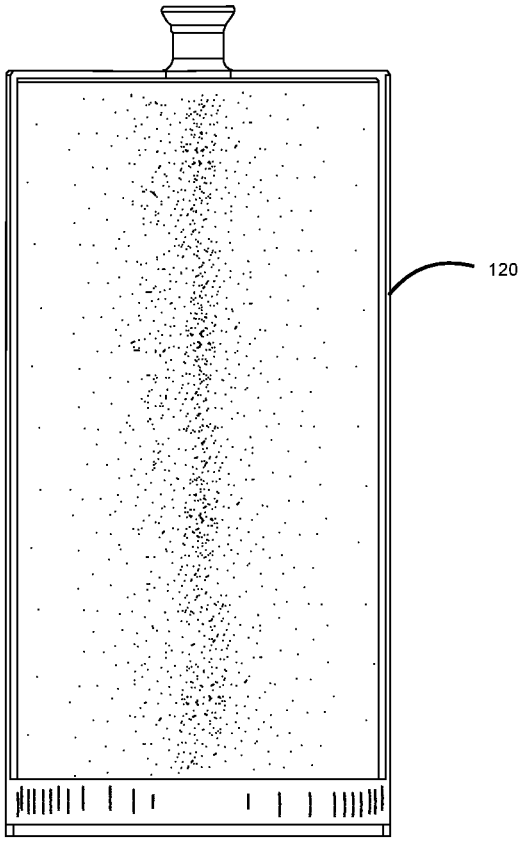
FIG. 5*b* shows the back side of an embodiment of an outer housing of an embodiment of a razor caddy assembly.
Figure 5C:
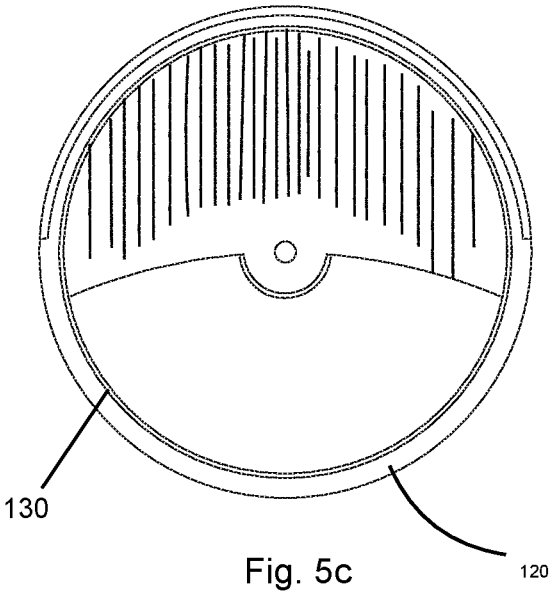
FIG. 5*c* shows the bottom side of an embodiment of an outer housing of an embodiment of a razor caddy assembly.
Figure 5D:
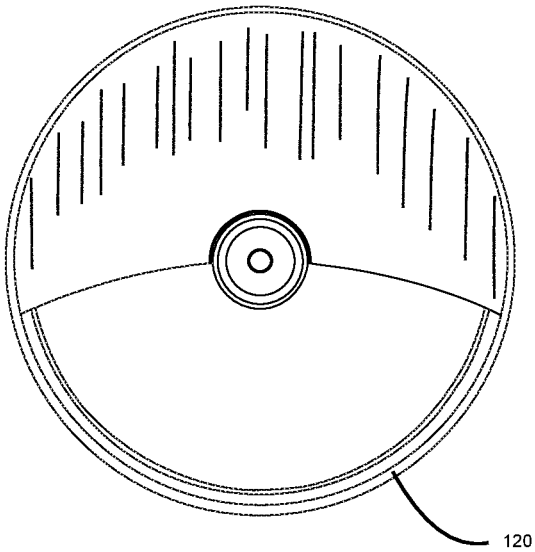
FIG. 5*d* shows the top side of an embodiment of an outer housing of an embodiment of a razor caddy assembly.
Figure 5E:
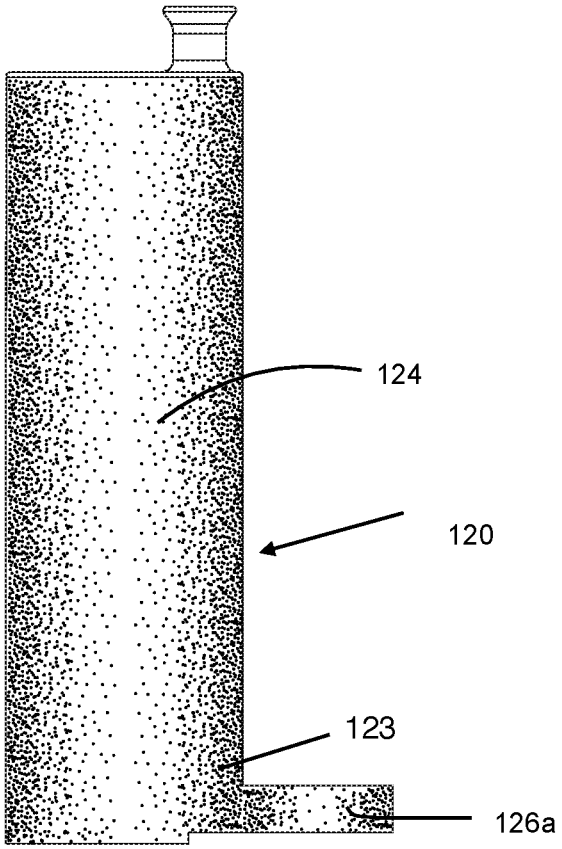
FIG. 5*e* shows the right side of an embodiment of an outer housing of an embodiment of a razor caddy assembly.
Figure 5F:
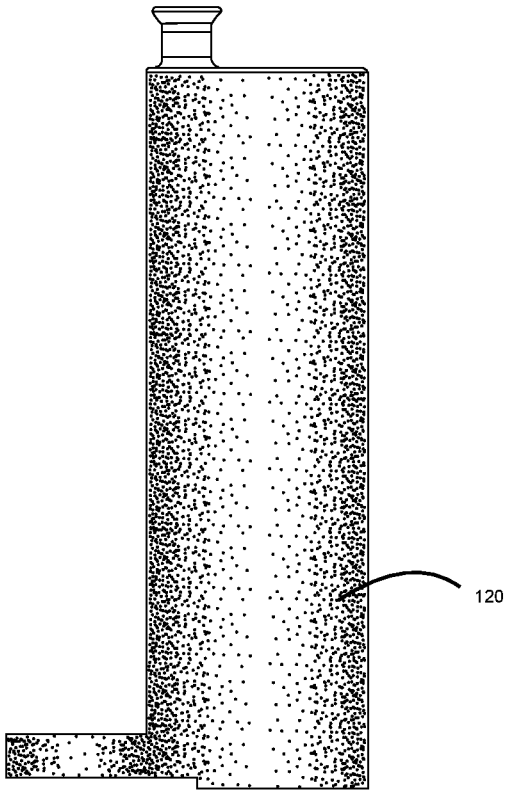
FIG. 5*f* shows the left side of an embodiment of an outer housing of an embodiment of a razor caddy assembly.
Figure 5G:
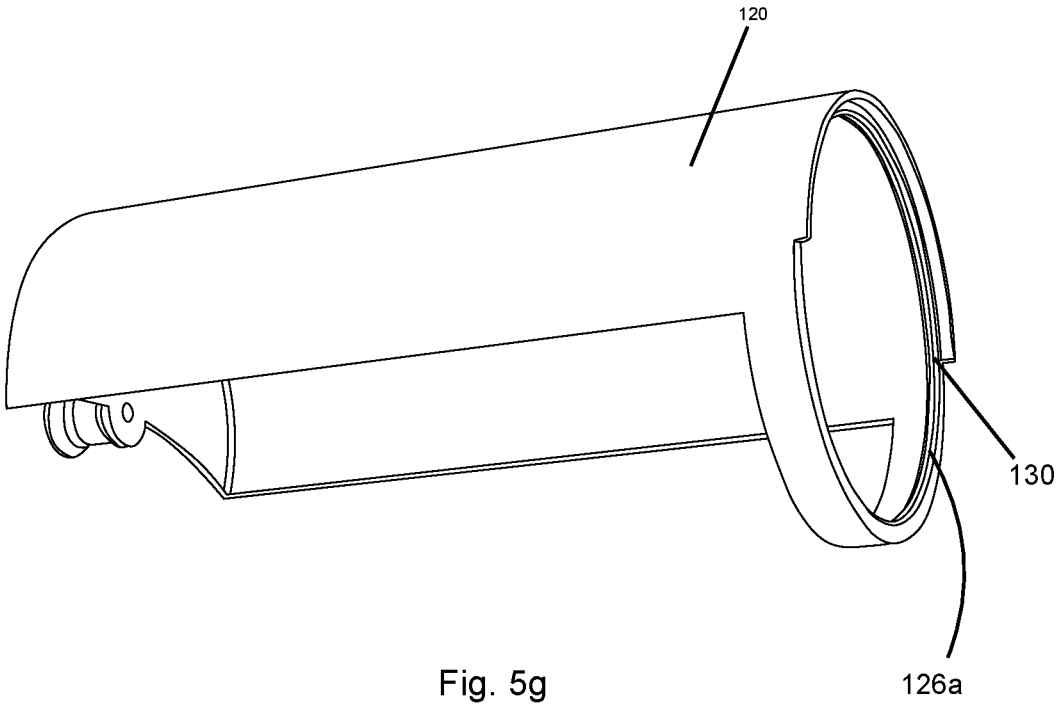
FIG. 5*g* shows a perspective view of the left side of an embodiment of an outer housing of an embodiment of a razor caddy assembly.
Figure 5H:
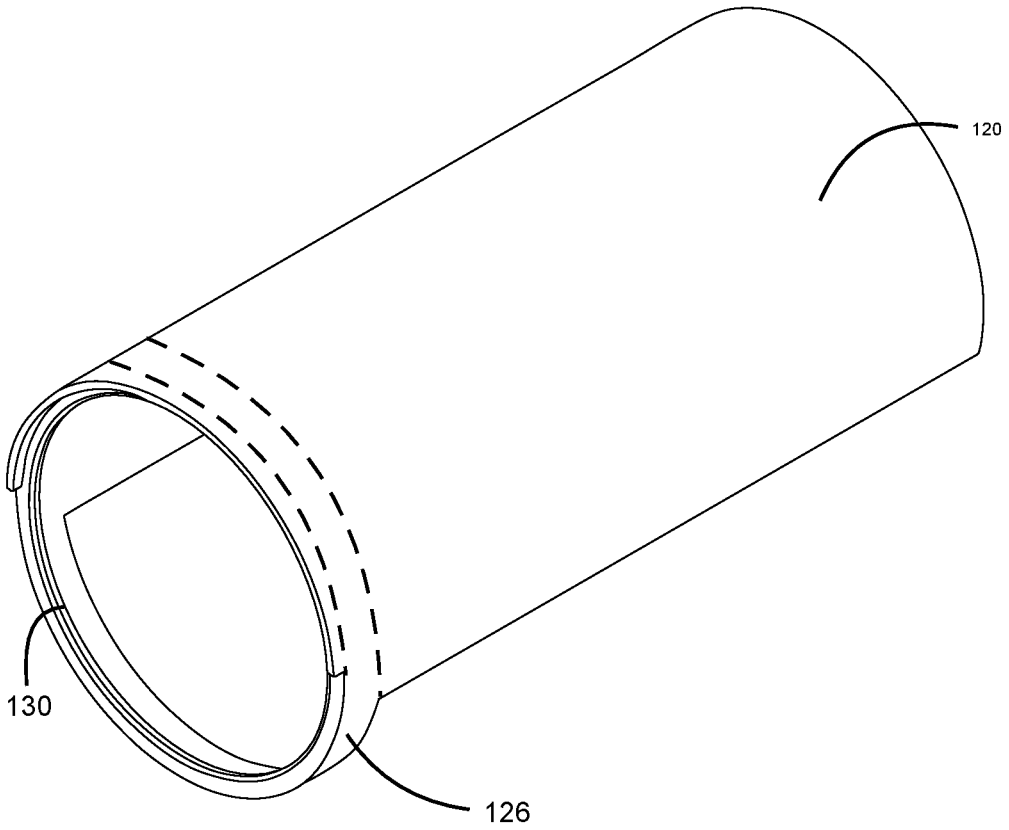
FIG. 5*h* shows a perspective view of an embodiment of the outer housing of an embodiment of a razor caddy, as seen from the bottom-front side.
Figure 6A:
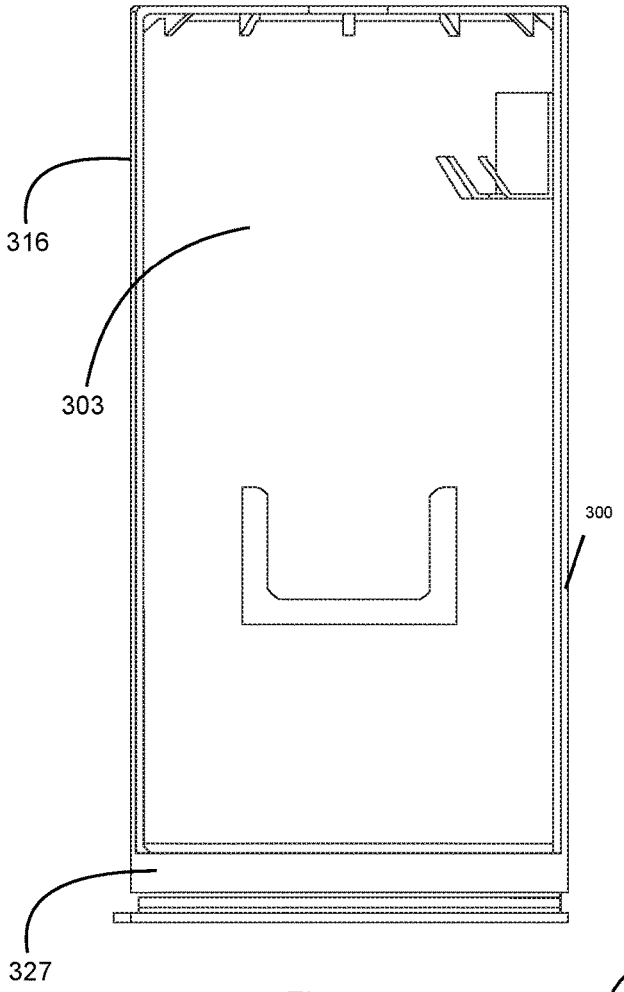
FIG. 6*a* shows a view of an embodiment of the inner housing of an embodiment of a razor caddy, as seen from the back side.
Figure 6B:
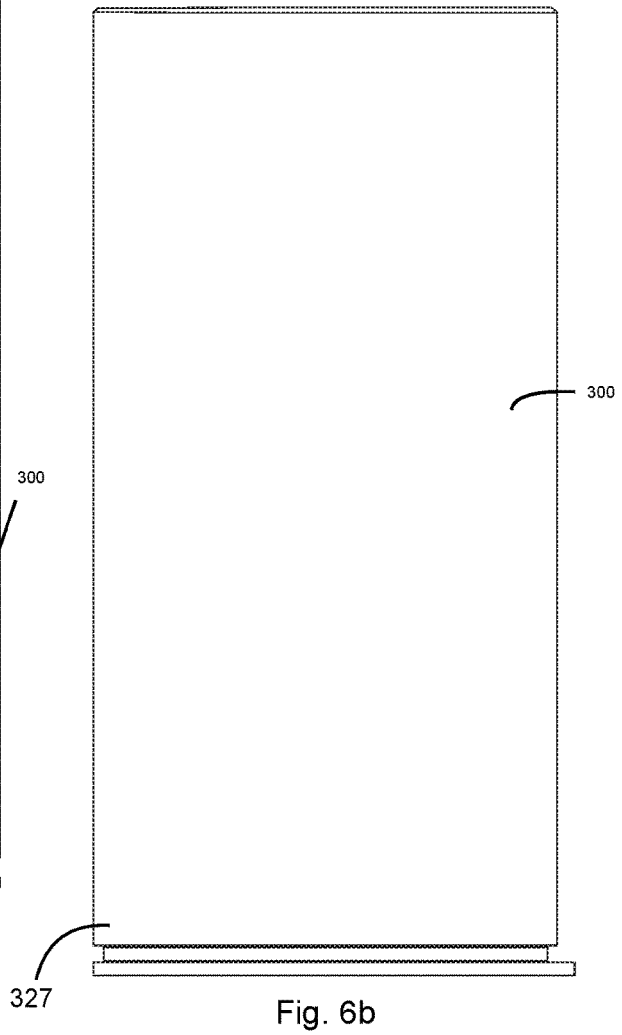
FIG. 6*b* shows a view of an embodiment of the inner housing of an embodiment of a razor caddy, as seen from the front side.
Figure 6C:
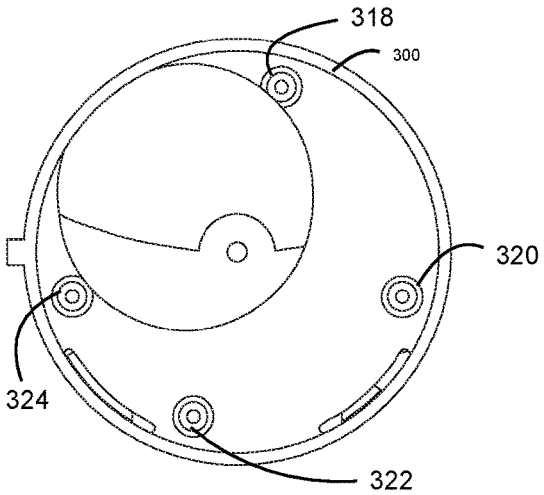
FIG. 6*c* shows a view of an embodiment of the inner housing of an embodiment of a razor caddy, as seen from the bottom side.
Figure 6D:
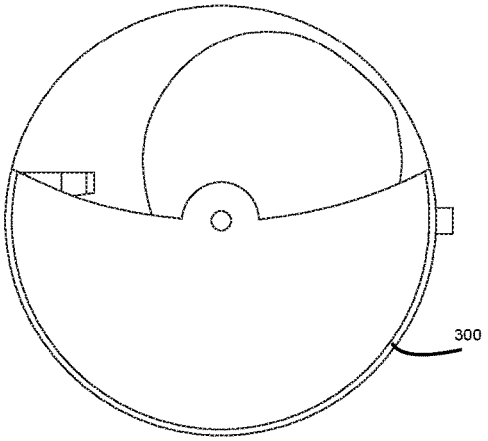
FIG. 6*d* shows a view of an embodiment of the inner housing of an embodiment of a razor caddy, as seen from the top side.
Figure 6E:
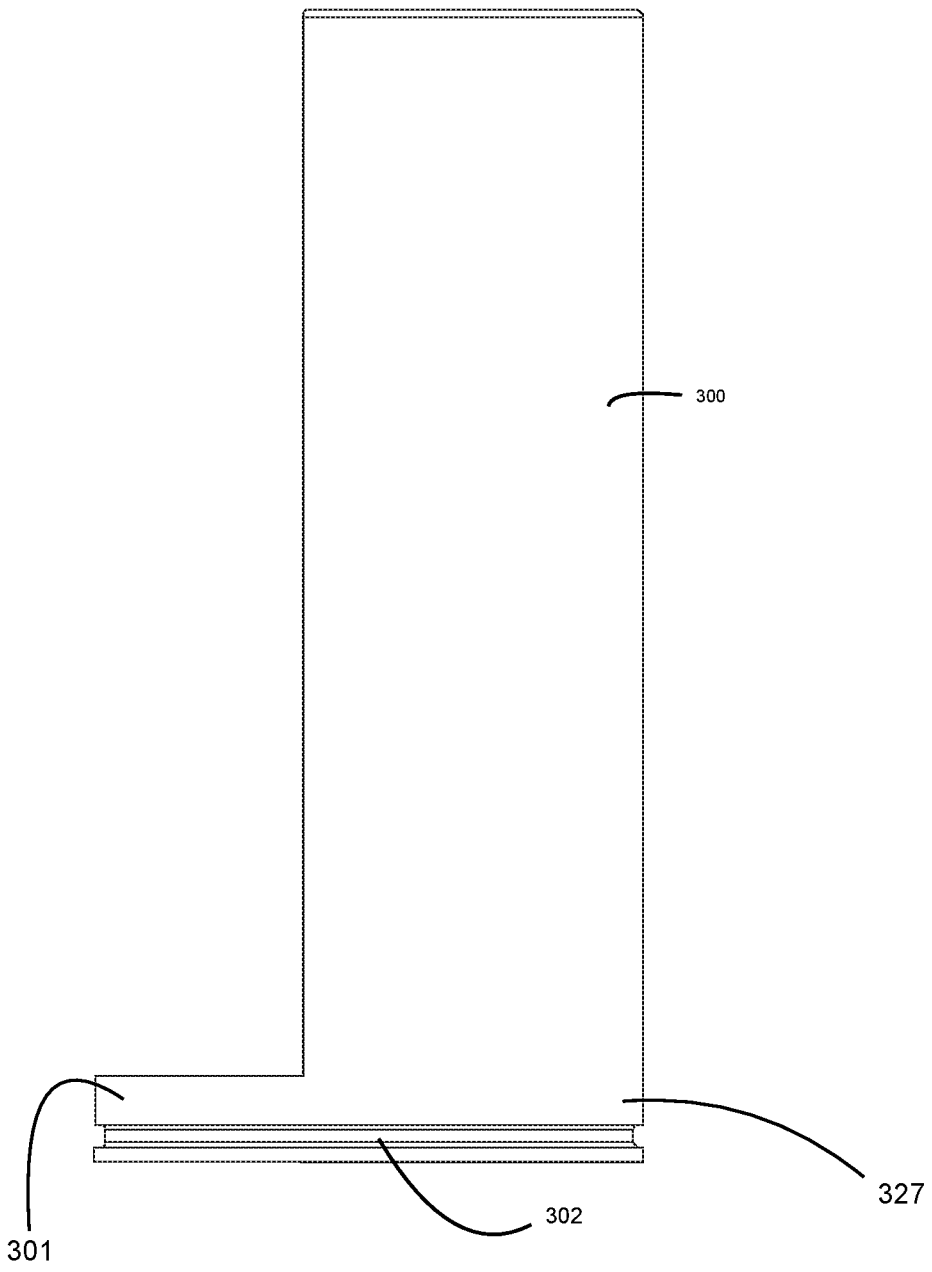
FIG. 6*e* shows a view of an embodiment of the inner housing of an embodiment of a razor caddy, as seen from the left side.
Figure 6F:
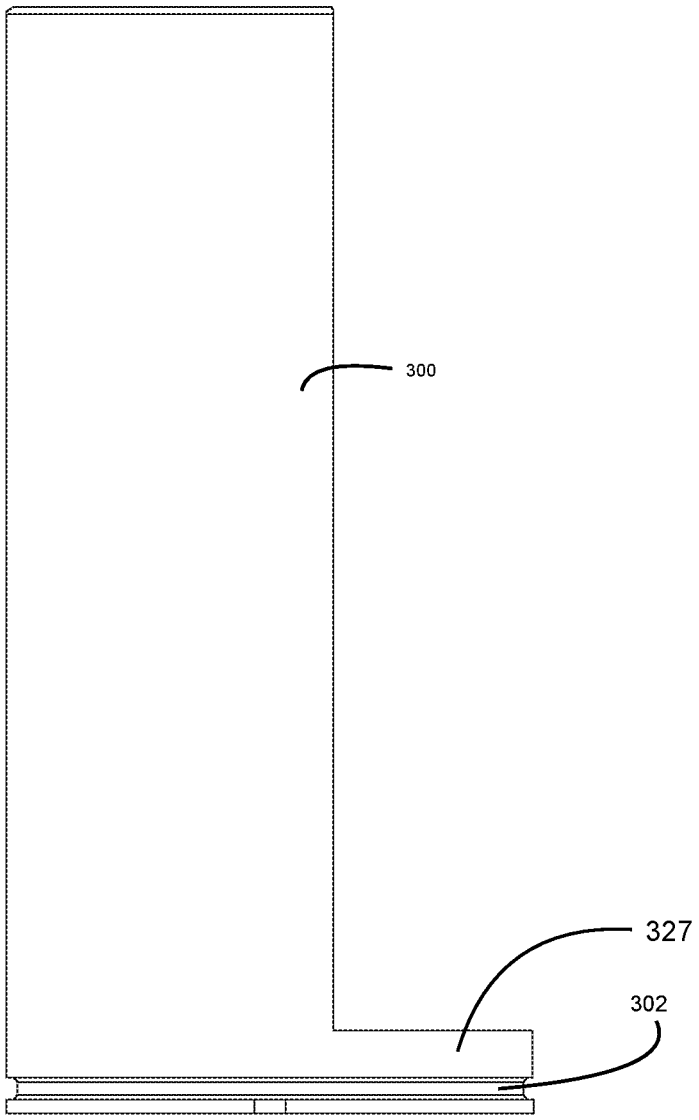
FIG. 6*f* shows a perspective view of an embodiment of the inner housing of an embodiment of a razor caddy, as seen from the right side.

The razor caddy assembly 100 may also have an inner housing 300 having a height; the inner housing 300 may be disposed within the outer housing 120, as shown in FIG. 1, and may have an inner housing connector 302 (see FIG. 6*e* in which the inner housing connector 302 is a channel; the inner housing connector 302 may be a channel or a rail and may be detachably coupled to the outer housing connector 130 (see FIG. 5*h* in which the outer housing connector 130 is depicted as a rail that is configured to be disposed within the channel of the housing connector 302; the inner housing 300 may have a lower rim 327, which may be annular; the lower rim 327 may be curved, and in the preferred embodiment the lower rim 327 may have a height between 0.01% and 30% of the height of the razor caddy assembly; and in the preferred embodiment the lower rim 327 may have a height between 0.2% and 20% of the height of the razor caddy assembly; and in the preferred embodiment the lower rim 327 may have a height between 7% and 14% of the height of the razor caddy assembly.

Figure 3:
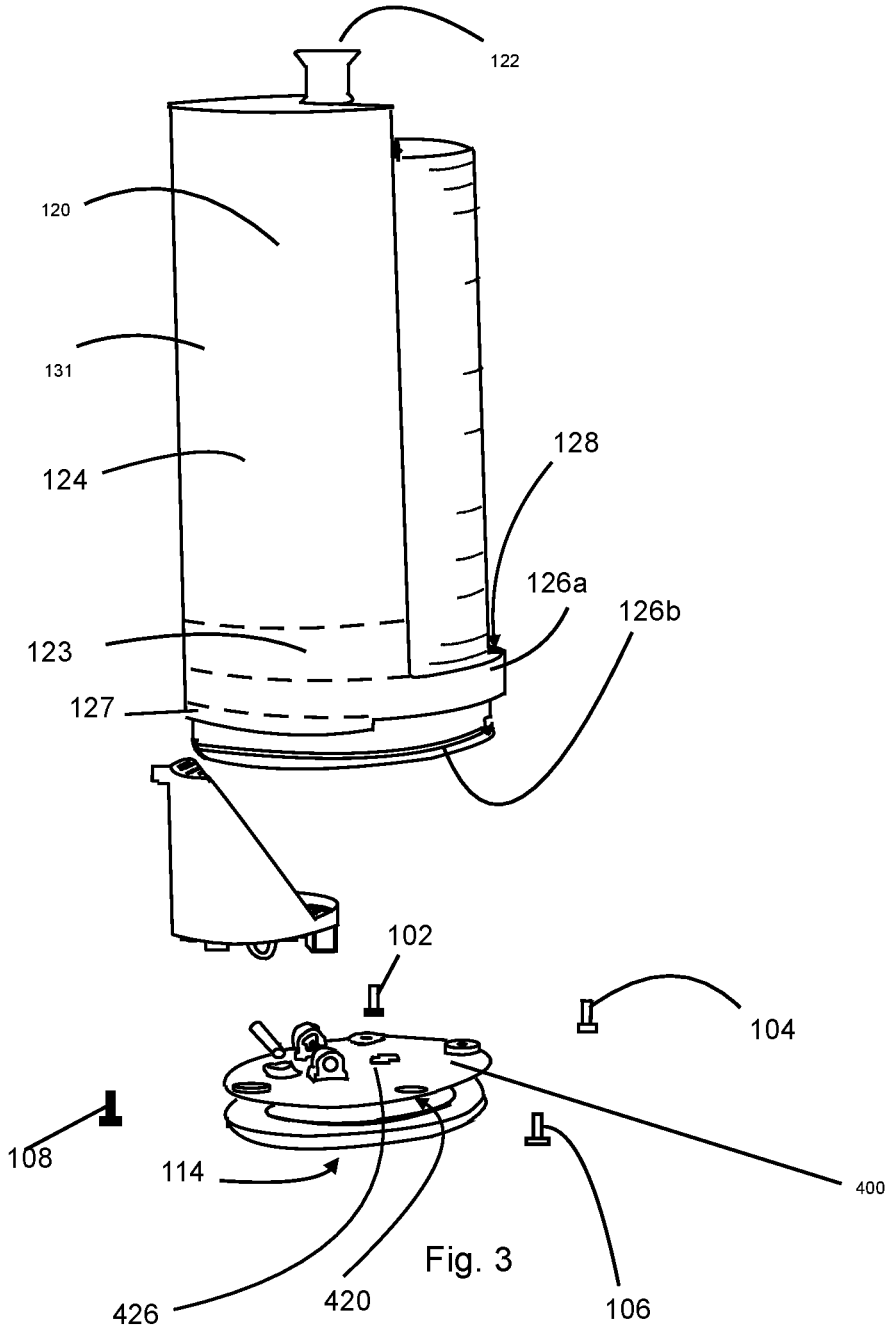
FIG. 3 shows an exploded view of an embodiment of the razor caddy assembly.
Figure 7A:
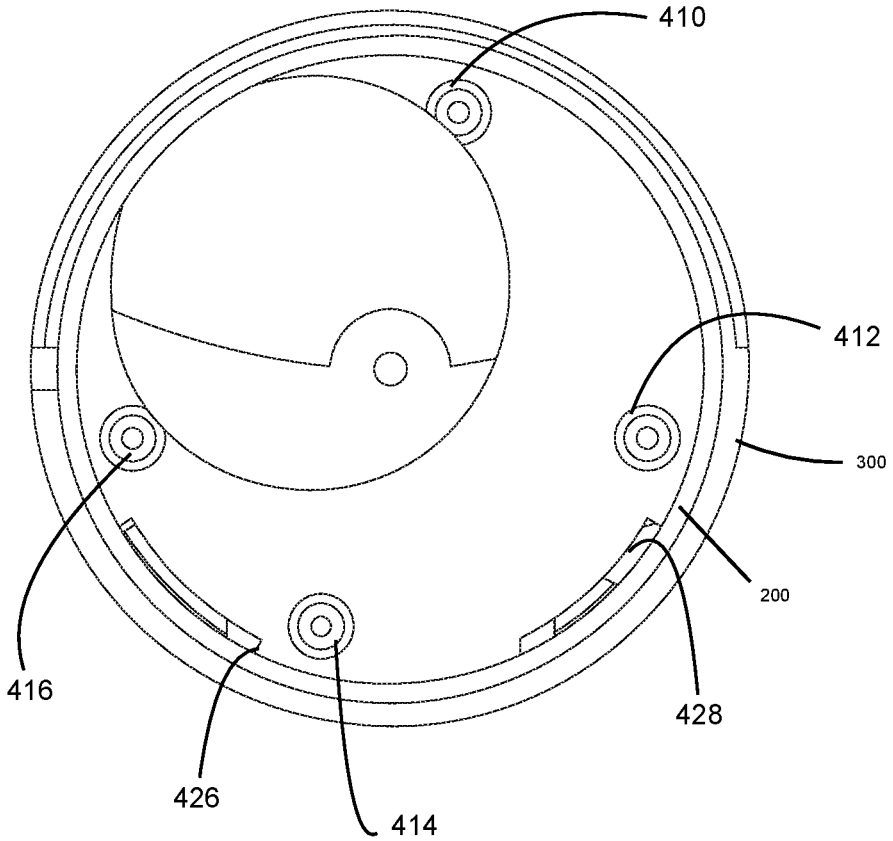
FIG. 7*a* shows an embodiment of the inner housing disposed within an embodiment of the outer housing, as seen from the bottom side; the top half generally represents the back side.
Figure 7B:
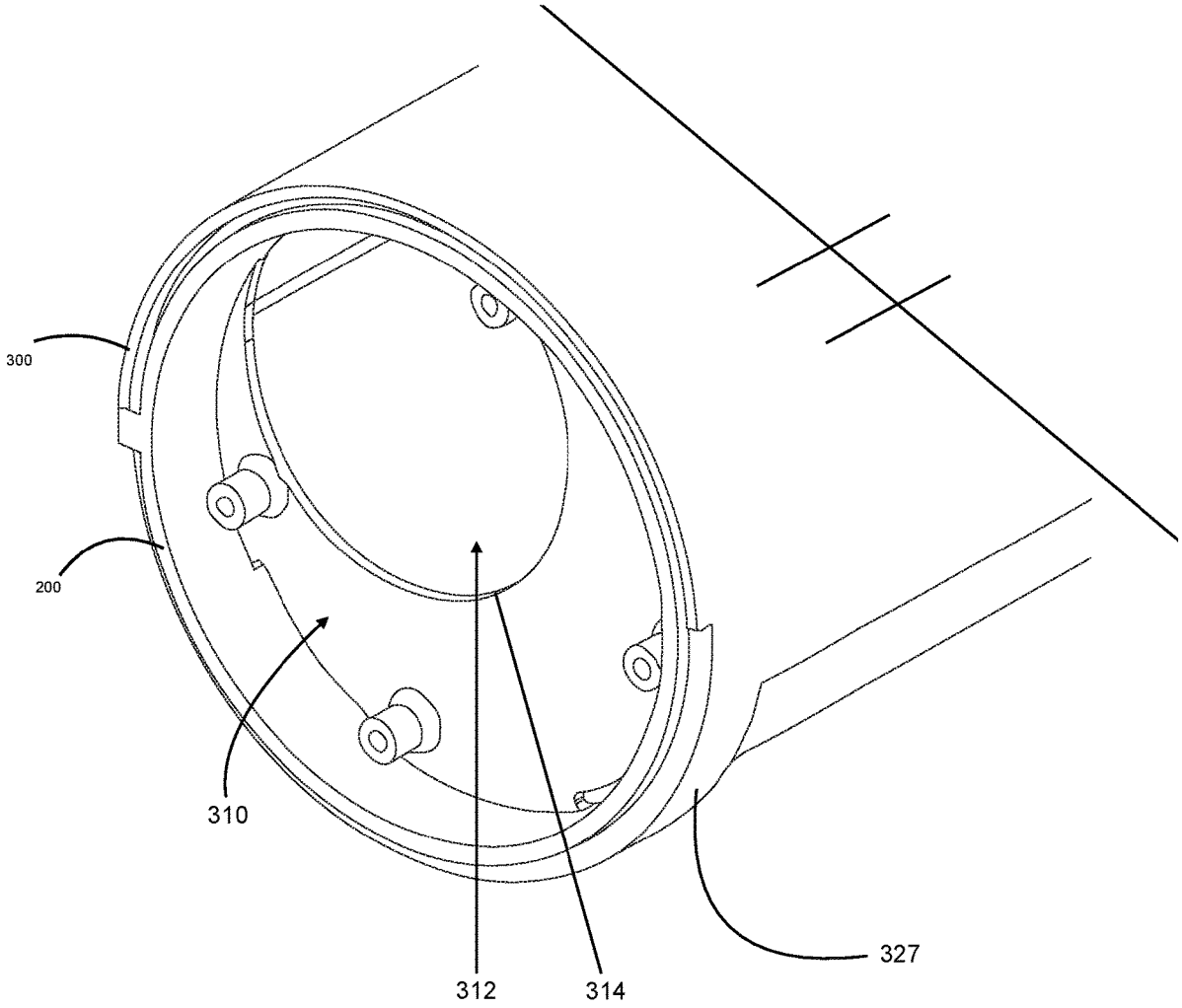
FIG. 7*b* shows a perspective view of an embodiment of the inner housing disposed within an embodiment of the outer housing, as seen from the bottom-front-right side.
Figure 7C:
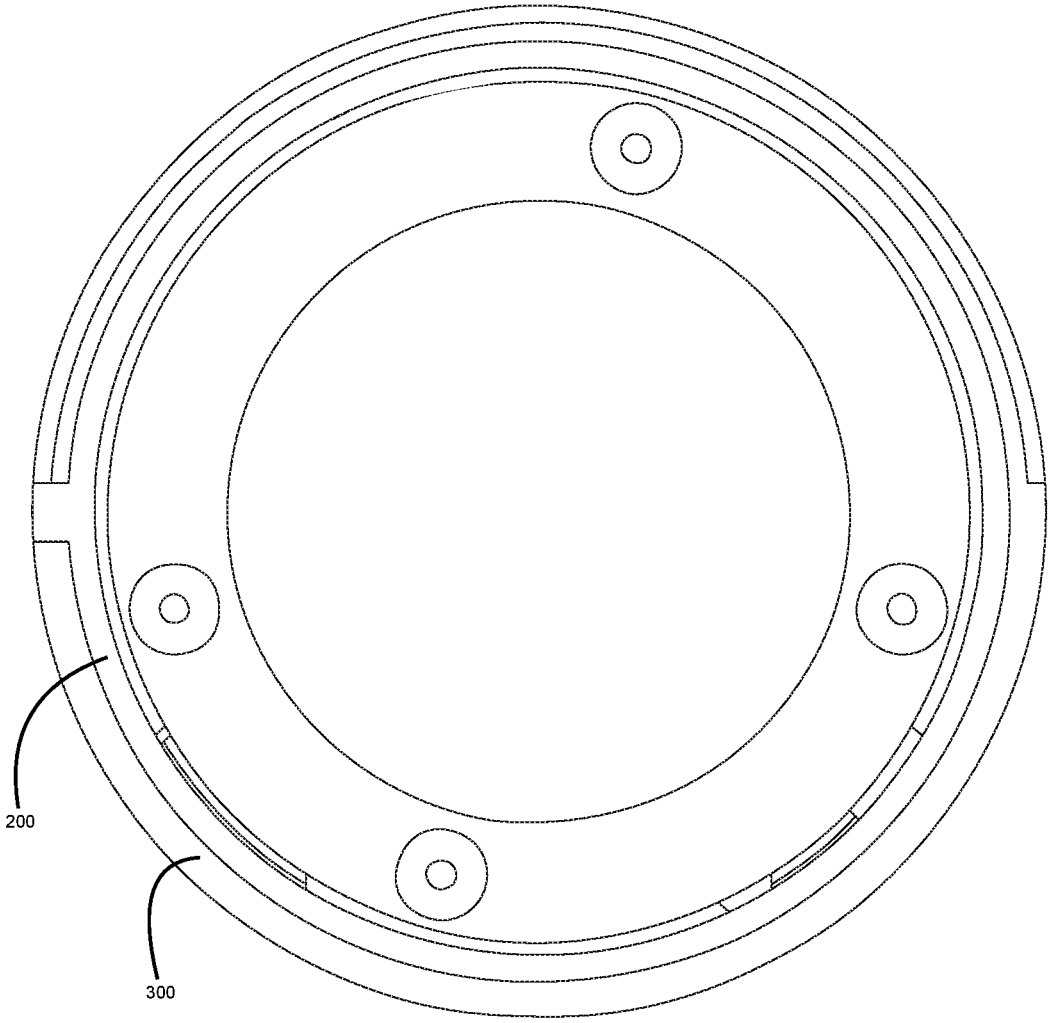
FIG. 7*c* shows a view of an embodiment of the inner housing disposed within an embodiment of the outer housing, as seen from the bottom side.
Figure 7D:
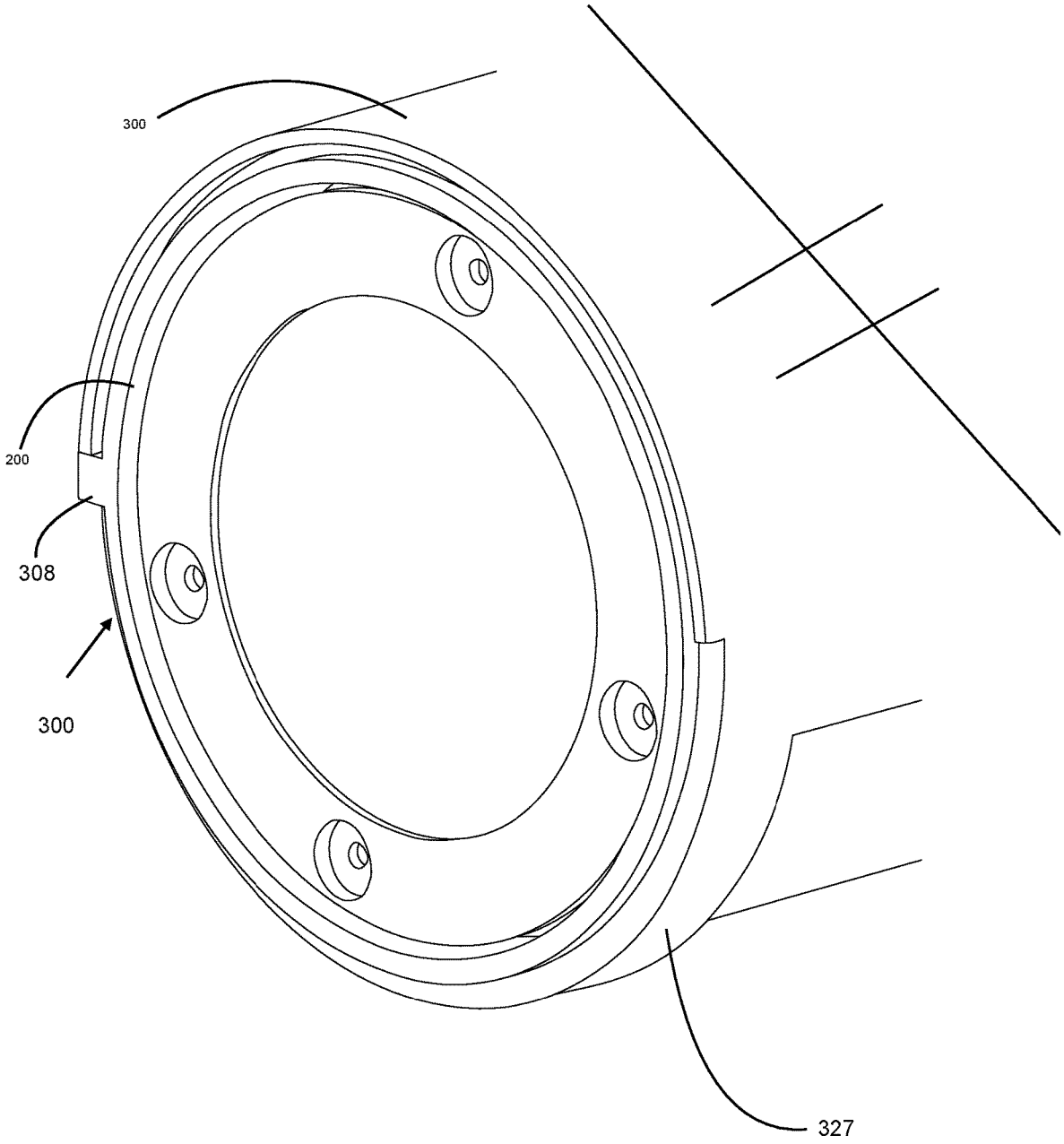
FIG. 7*d* shows a view of an embodiment of the inner housing disposed within an embodiment of the outer housing, as seen in FIG. 7*b* except that the plate has positioned so as to obstruct the view of the bottom portion of the inner housing.

Referring to FIG. 3, the razor caddy assembly 100 may have a plate 400 comprising a top surface 422; the plate 400 may be coupled to the inner housing 300 (such as shown in FIG. 7*d* in which the plate 400 is coupled to the bottom portion of the inner housing 300; although not show in FIG. 7*d*, when fasteners are disposed through both the fastener receiver of the plate and the fastener receiver inner housing then the fasteners assist in coupling the plate 400 to the inner housing 300, such as by one or more fasteners; the razor caddy assembly 100 may have a holster 200 disposed within the inner housing and onto the plate 400, the holster 200 may have a first connecting member 205 and a second connecting member 207; the first connecting member 205 may have a bottom piece that is magnetic or partially magnetic; the second connecting member 207 may also have a bottom piece that is magnetic or partially magnetic. In the preferred embodiments, the holster 200 may have at least two connecting members and the plate 400 may also have at least two connecting members, and at least one of the connecting members of the holster 200 is magnetic and at least one of the connecting members of the plate 400 is magnetic; each of the connecting members of the holster 200 may be paired up with a corresponding connecting member of the plate 400, thereby forming two connecting member pairs; in some embodiments, only one connecting member of the connecting member pair has a magnet, but in some embodiments both connecting members of a connecting member pair have a magnet; in some embodiments, at least two of the magnets of the connecting member pair are attracted to each other.

The plate 400 may further comprise a third connecting member 407 and a fourth connecting member 409; the third connecting member 407 and a fourth connecting member 409 may be metallic, such as a nut, and may be attracted to the corresponding connecting member of the holster 200. In some embodiments, the third connecting member 407 may have a magnet and a fourth connecting member 409 may have a magnet; In some embodiments, the magnet of the third connecting member 407 may be attracted to the magnet of the first connecting member 205 and the magnet of the fourth connecting member 409 may be attracted to the magnet of the second connecting member 207. In some embodiments, the use of a magnet of the holster that is attracted to a magnet of the plate to detachably couple the holster to the plate may be substituted or replaced with other coupling systems, such as a hook-loop system or physical coupling mechanisms.

Figure 8A:
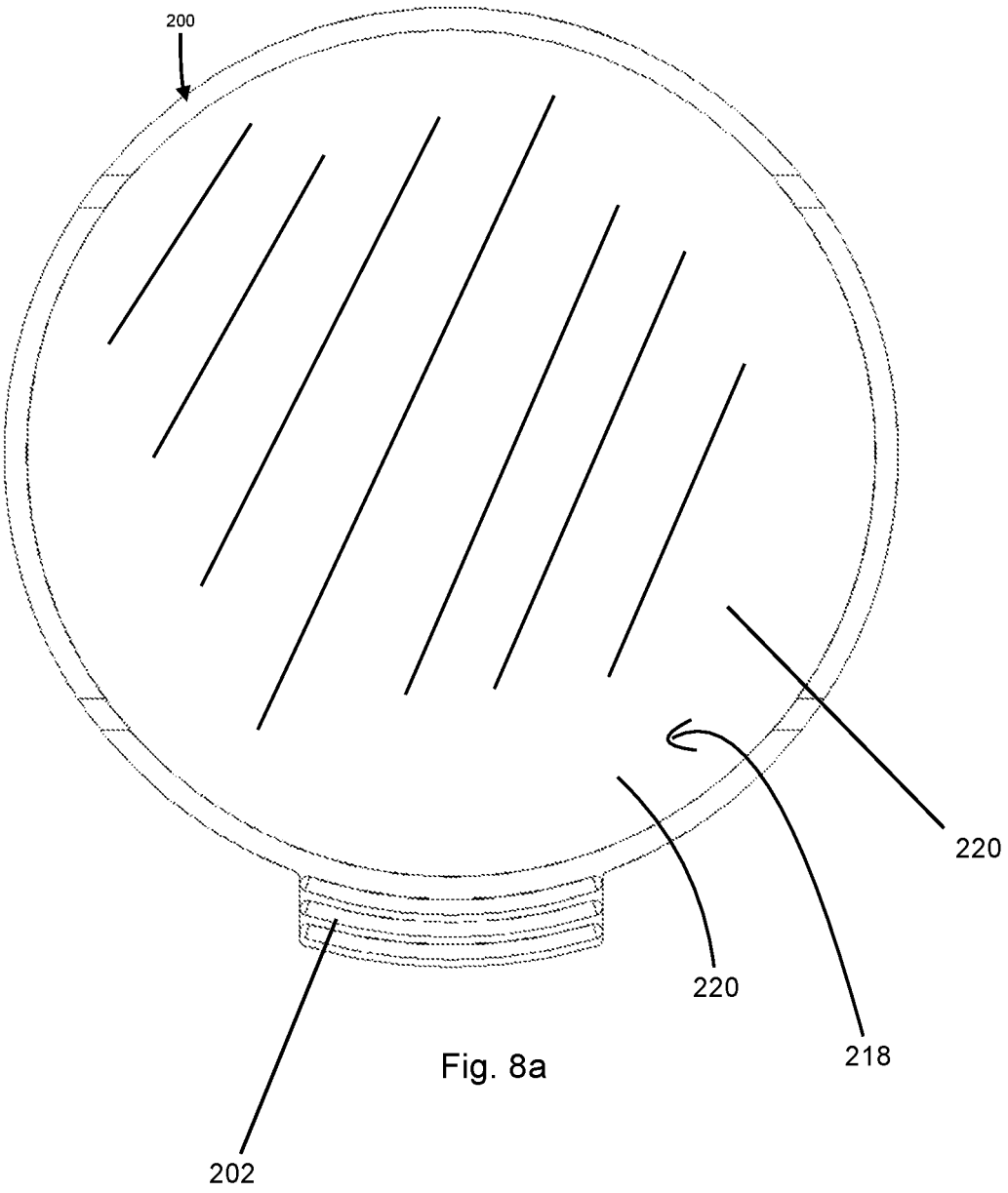
FIG. 8*a* shows a top view of a holster; the front side is at the bottom of the page.
Figure 8G:
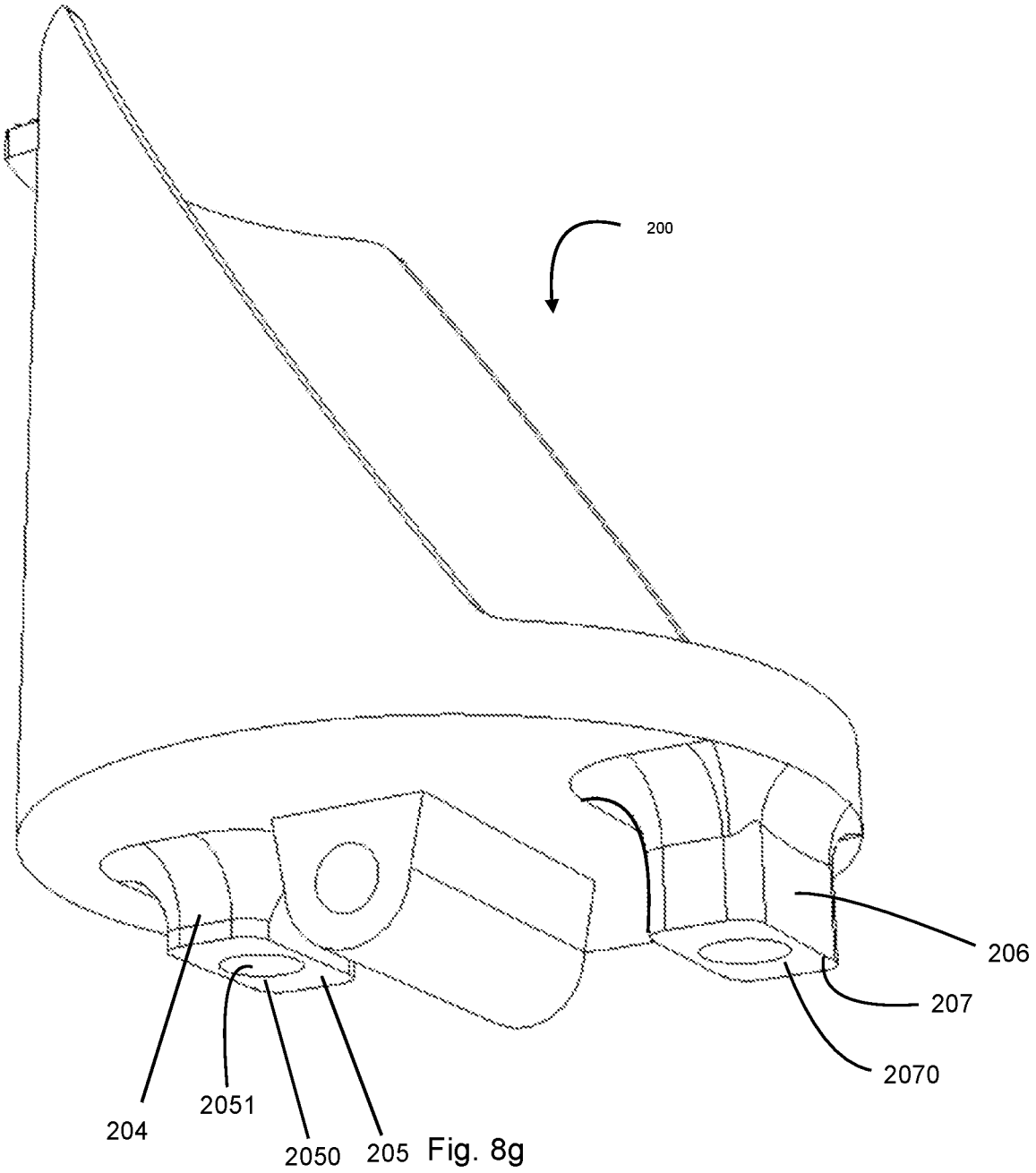
FIG. 8*g* shows a right-bottom-back view of the embodiment of the holster of FIG. 8*d;*
Figure 9:
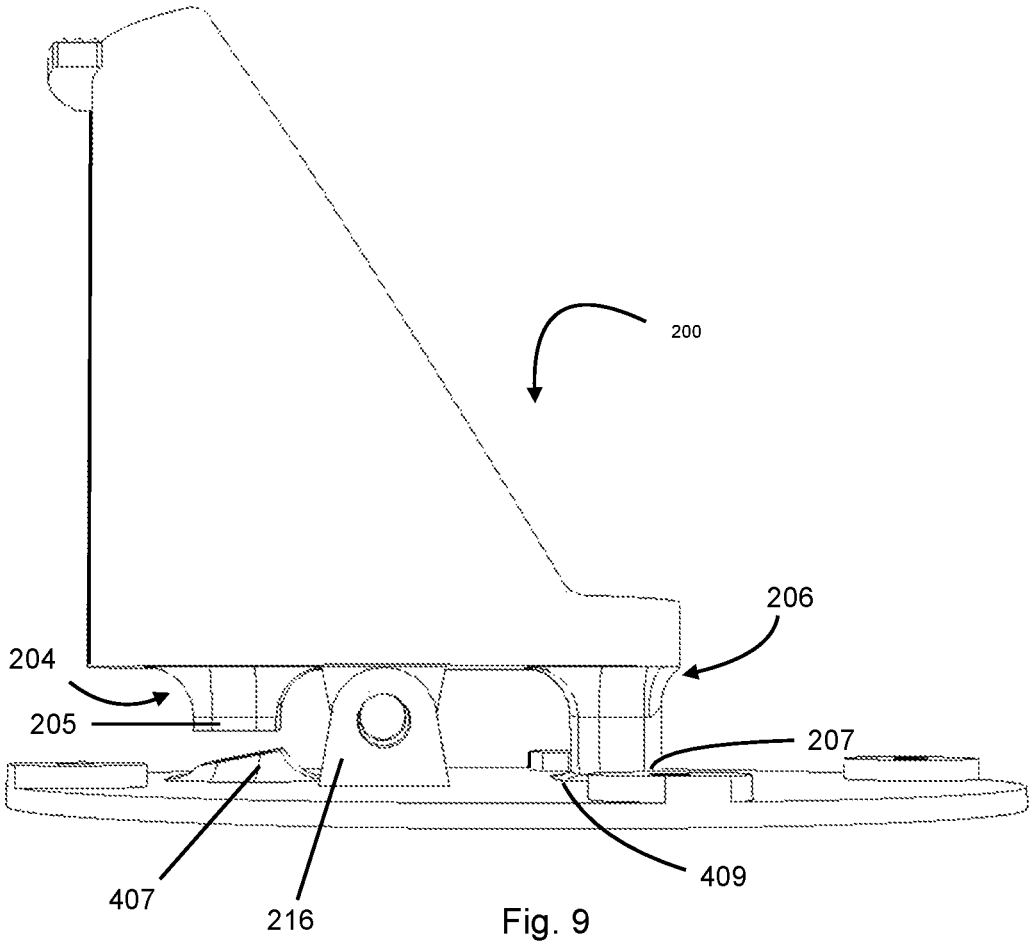
FIG. 9 shows a right side of a holster when it is coupled to a plate; the view of the plate is a perspective view as shown from the right side.

Referring to FIG. 9, in some embodiments, the first connecting member 205 of the holster, which may be detachably coupled or undetachably coupled to a holster short leg 204, may be magnetically and detachably coupled to the third connecting member 407 of the plate 400 when the second connecting member 207 of the holster 200 is not coupled to the fourth connecting member 409 of the plate 400. In the preferred embodiments, a first magnet holder 2050 (see FIG. 8*g* for an embodiment) may be disposed at a bottom end of the first connecting member 205; the first magnet holder may have a first magnet 2051 (see FIG. 8*g* for an embodiment) or a first metallic member (not shown) that may be attracted to a magnet disposed in a third magnet holder.

In some embodiments, the third connecting member 407 of the plate 400 may have a third magnet holder 4070 that may be disposed at the top end of the third connecting member 407; a third magnet 4071 or a third metallic member (not shown) that may be attracted to a magnet disposed in the first magnet holder may be disposed within the third magnet holder 4070. The third connecting member 407 may be angled between 0.1 degrees and 89 degrees or any range in between.

Figure 8B:
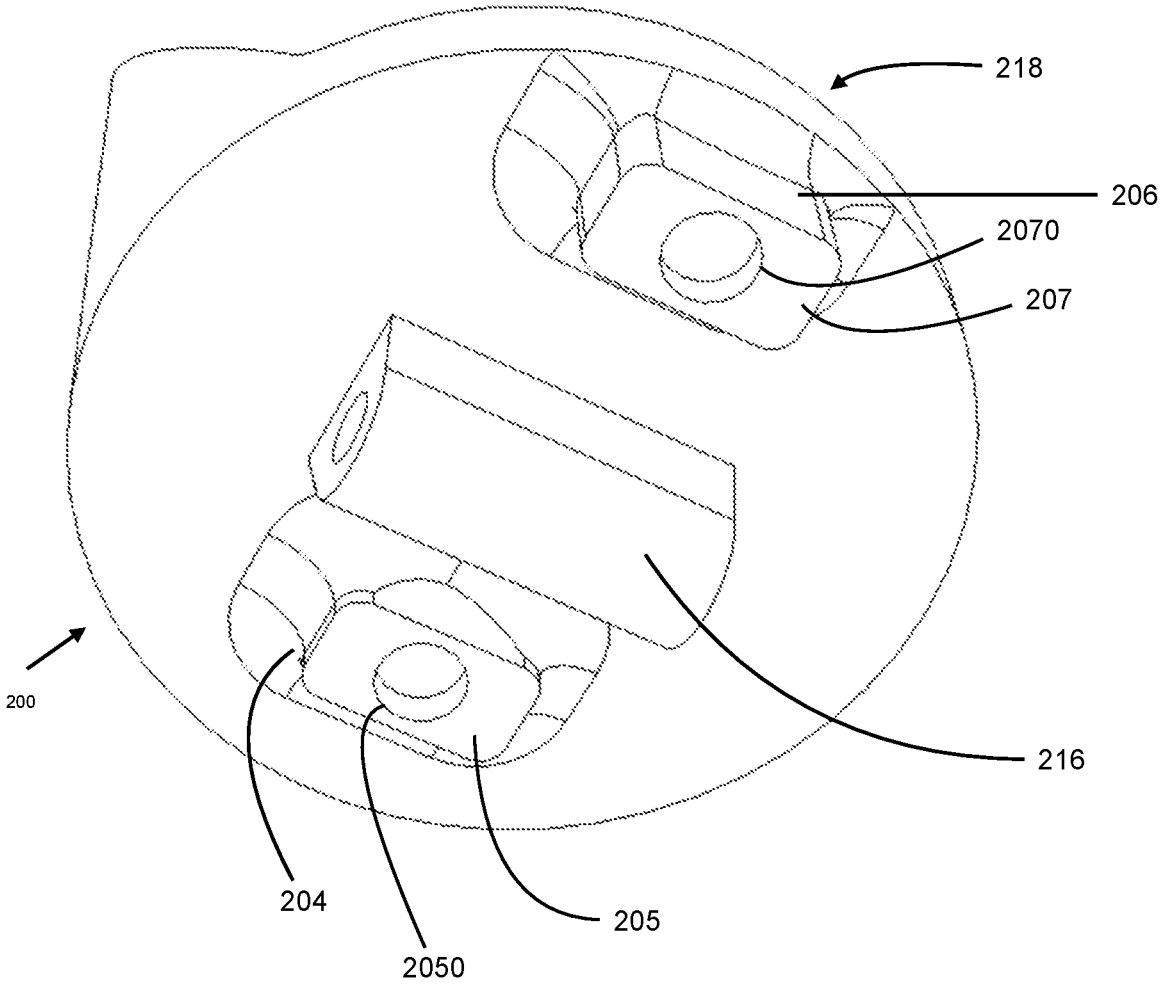
FIG. 8*b* shows a bottom-right side view of the embodiment of the holster of FIG. 8*a;*
Figure 8C:
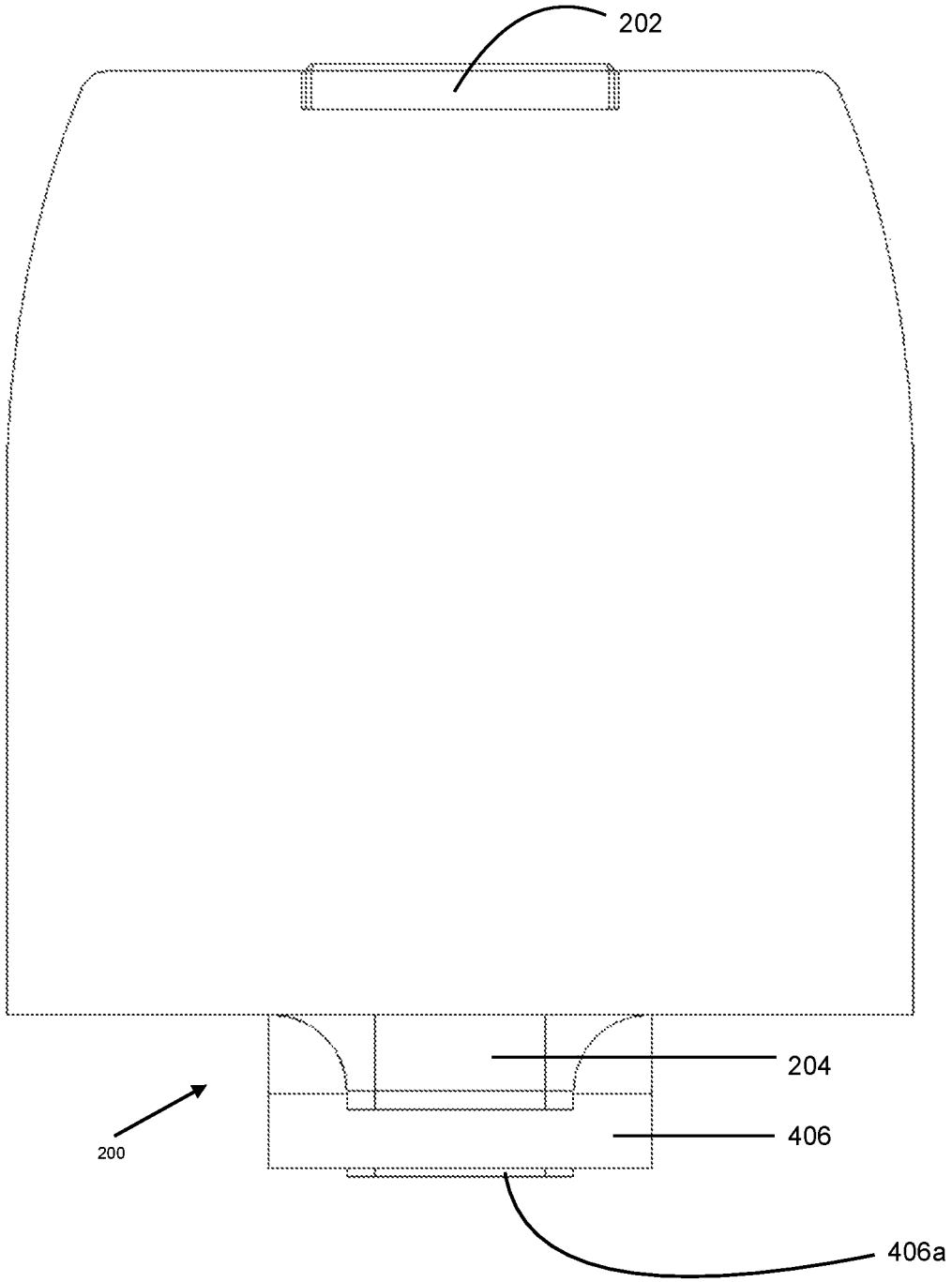
FIG. 8*c* shows a front view of the embodiment of the holster of FIG. 8*a;*
Figure 8D:
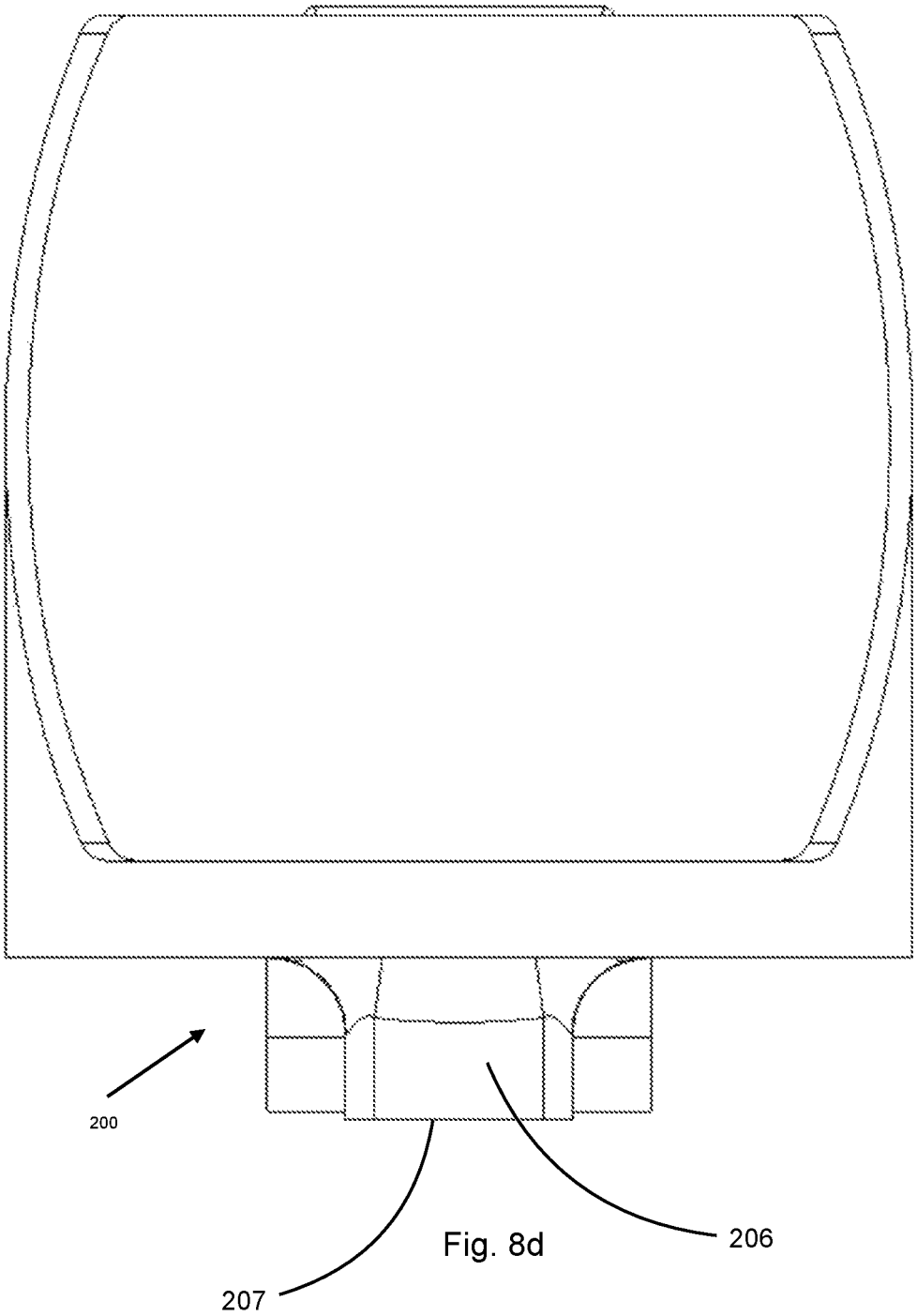
FIG. 8*d* shows a back view of the embodiment of the holster of FIG. 8*a;*
Figure 8E:
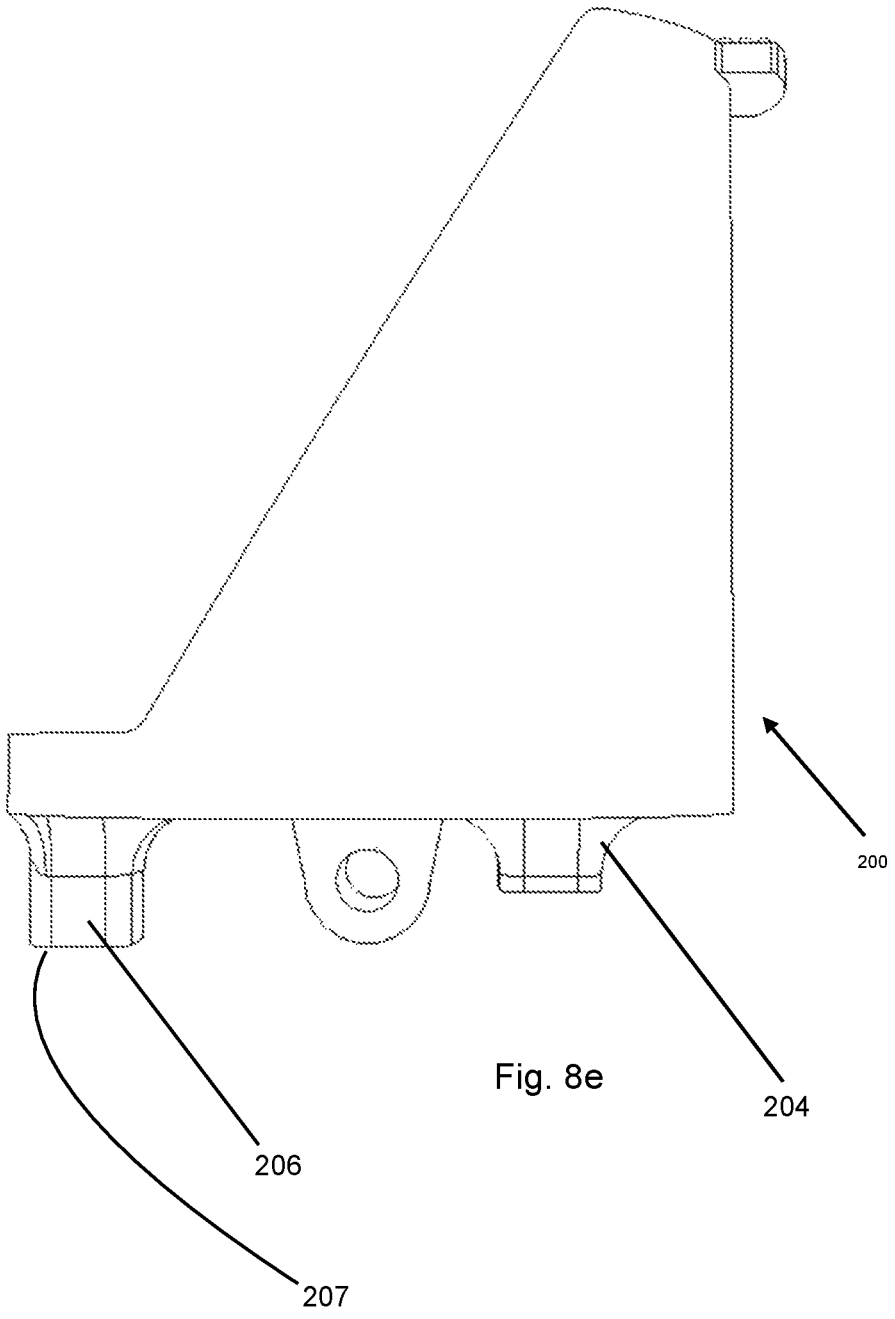
FIG. 8*e* shows a left view of the embodiment of the holster of FIG. 8*d;*
Figure 8F:
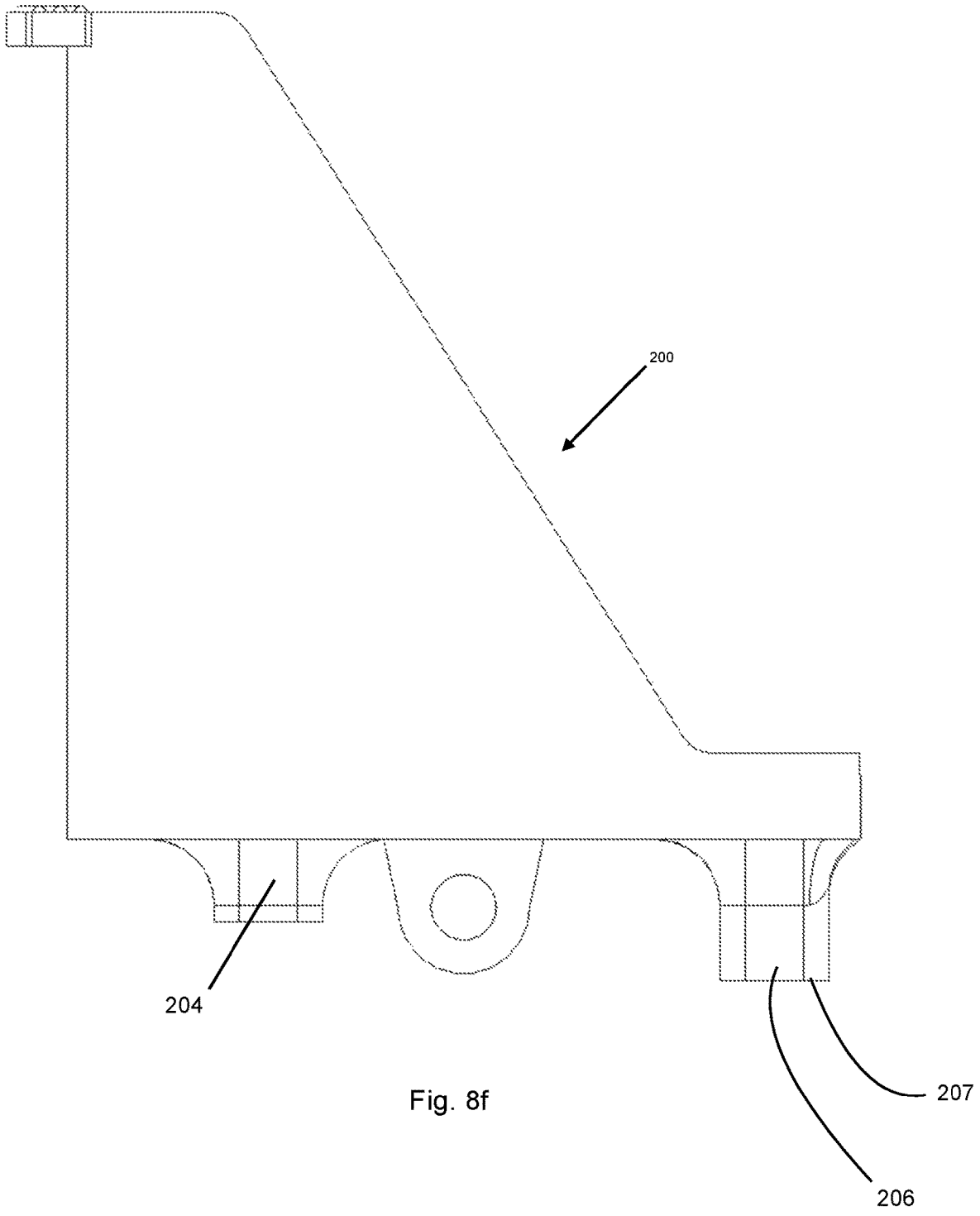
FIG. 8*f* shows a right view of the embodiment of the holster of FIG. 8*d;*

Referring to FIG. 8*b*, the magnetic holders are shown without any magnets or any metallic members.

Referring to FIG. 9, in some embodiments, the second connecting member 207 of the holster may be magnetically and detachably coupled to the fourth connecting member 409 of the plate 400 when the first connecting member 205 of the holster 200 is not coupled to the third connecting member 407 of the plate 400. In the preferred embodiments, a second magnet holder 2070 may be disposed at a bottom end of the second connecting member 207; the second magnet holder may have a second magnet 2051.

removing a can disposed within the holster;

removing a razor from a razor rack coupled to an inner wall of the housing;

returning the can to the holster;

returning the razor to the razor rack;

tilting the holster so as to cause a holster long leg to magnetically couple, via a magnet of the first connecting member, to the third connecting member of the plate; and, rotating the outer housing so as to substantially obscure from view the inner surface of the inner housing with the outer housing.

In the preferred embodiments, a second magnet holder 2070 (see FIG. 8*g* for an embodiment) may be disposed at a bottom end of the first connecting member 207; the first magnet holder may have a first magnet 2051 (see FIG. 8*g* for an embodiment) or a first metallic member (not shown) that may be attracted to a magnet disposed in a third magnet holder.

In some embodiments, the third connecting member 407 of the plate 400 may have a third magnet holder 4070 that may be disposed at the top end of the third connecting member 407; a third magnet 4071 (which may be of any shape but is shown here as hexagonal) or a third metallic member (not shown, which may be of any shape but is shown here as hexagonal) that may be attracted to a magnet disposed in the first magnet holder may be disposed within the third magnet holder 4070. The third connecting member 407 may be angled.

In some embodiments, the fourth connecting member 409 of the plate 400 may have a fourth magnet holder 4090 that may be disposed at the top end of the fourth connecting member 409; a fourth magnet 4091 or a fourth metallic member (not shown) that may be attracted to a magnet disposed in the second magnet holder may be disposed within the fourth magnet holder 4090. The fourth connecting member is preferably not angled to the same degree that the third connecting member 407 is angled.

For purposes, of this disclosure, a magnetic holder may not necessarily be a magnet.

Alternatively, the second connecting member 205 of the holster may be magnetically and detachably coupled to the fourth connecting member 409 of the plate 400 when the first connecting member 207 of the holster 200 is not coupled to the third connecting member 409 of the plate 400. the razor caddy assembly 100 may also a main base 114, the main base 114 coupled to the plate 400.

Figure 4:
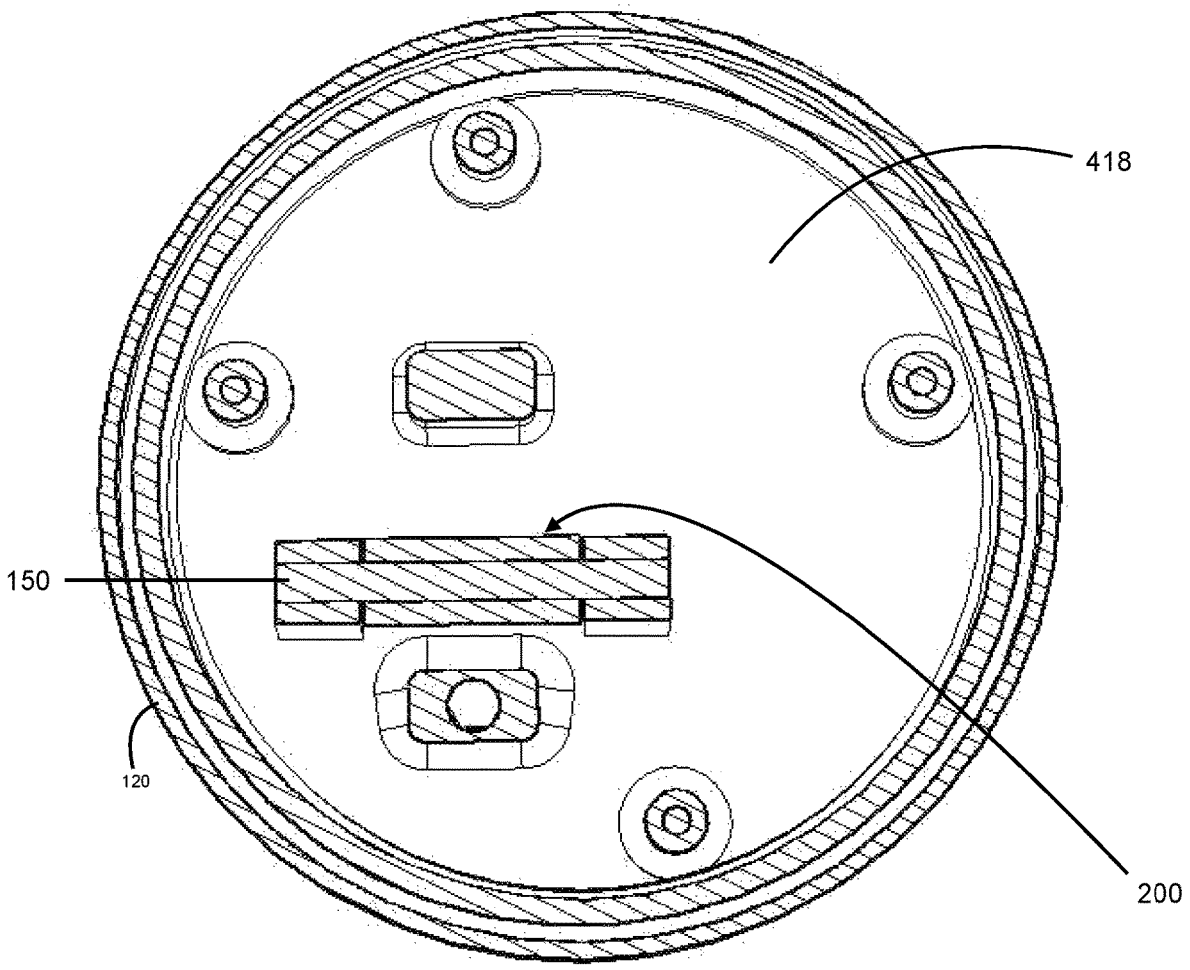
FIG. 4 shows a cross-sectional view of an embodiment of the razor caddy assembly; the dotted line of FIG. 1*e* shows where the plane has been taken for the cross-section.

Referring to FIG. 4 and FIG. 5*e*, the razor caddy assembly 100 may further have a spindle 150 coupled to the holster 200; the outer housing 120 may further have a lower rim 126*a* of the outer housing 120; the lower rim 126*a* of the outer housing 120 may define an opening 128, the outer housing 120 may have an interior surface, the lower rim 126*a* may have a circumference having a length.

Referring to FIG. 5*e*, the razor caddy assembly 100 may further have a side wall 124 of the outer housing 120; the side wall 124 of the outer housing 120 may have a bottom rim 123 of the side wall 124 of the outer housing 120, the bottom rim 123 of the side wall 124 of the outer housing 120 may define an arc having a length, and the vertical height of the bottom rim 123 may be between 0.001 inches and 3 inches; the length of the arc of the bottom rim 123 of the side wall 124 of the outer housing 120 may be less than the length of the circumference of the lower rim 126*a* of the outer housing 120. Referring back to FIG. 3, an embodiment of a bottom rim 123 of the side wall 124 of the outer housing 120, an embodiment of a lower rim 126*a* of the outer housing 120, and an embodiment of a lowest rim 127 of the outer housing 120 are depicted. In the preferred embodiments of razor caddy assembly 100, the lowest rim 127 of the outer housing 120 defines the lowest portion of the outer housing 120. In the preferred embodiments, the lower rim 126*a* is disposed above the lowest rim 127, and in some preferred embodiments the bottom rim 123 is disposed above the lower rim 126*a*. In the preferred embodiments, the lower rim 126*a* is circular and has a greater length then the bottom rim 123. In the preferred embodiments, bottom rim 123 has a greater length than the lowest rim 127. In the preferred embodiments, as shown in FIG. 3, the opposing end of lowest rim 127 is not visible but may abut stopper 308 of inner housing 300.

Referring to FIG. 6*c*, a view of an embodiment of the inner housing of an embodiment of a razor caddy, as seen from the bottom side is depicted; a first fastener receiving member 318 may be circular and may have an opening for receiving a fastener such as a screw, the first fastener receiving member 318 may extend from the floor 310 of the inner housing 300; the second fastener receiving member 320 may be circular and may have an opening for receiving a fastener such as a screw, the second fastener receiving member 320 extending from the floor 310 of the inner housing 300; the third fastener receiving member 322 may be circular and may have an opening for receiving a fastener such as a screw, the third fastener receiving member 322 may extend from the floor 310 of the inner housing 300; the fourth fastener receiving member 324 may be circular and may have an opening for receiving a fastener such as a screw, the fourth fastener receiving member 324 may extend from the floor 310 of the inner housing 300.

Referring to FIG. 6*c*, a first slot 330*a* of inner housing 300 may be elongated and may form an opening for liquid drainage; a second slot 330*b* of inner housing 300 may also be elongated and may form an opening for liquid drainage.

Referring to FIG. 8*a*, FIG. 8*b*, the holster 200 of the razor caddy assembly 100 may further have a floor 218 of the holster 200, the floor 218 of the holster 200 may have a main surface 220, the main surface 220 may have an area. In the preferred embodiments, the floor 218 has a greater thickness than the main surface 220; the main surface 220 may refer to the upper surface of the floor 218 upon which a shaving cream can may be placed. The holster 200 may further have a spindle holder 216 (see also FIG. 9) of the holster 200, the spindle holder 216 having a length. Spindle holder 216 may be shaped as a cylindrical member having a hollow space. The holster 200 may further have a holster grip 202 (see FIG. 8*a*), a holster short leg 204, a holster long leg 206, and a first fastener receiver 208. In the preferred embodiments, holster long leg 206 is longer in height than the short leg 204.

Referring to FIG. 7*d*, the inner housing 300 of the razor caddy assembly 100 may further have a stopper 308 having a length; the stopper 308 may be disposed on the exterior surface of the inner housing 300. The stopper 308 may be a block-like member, column-like member, or a flange that is configured to stop the rotation of the outer housing. The length or height of the stopper may extend substantially along the length or height of the inner housing 300, or the length of the stopper have a height that is between 0.01% and 10% of the height of the inner housing 300.

Figure 6G:
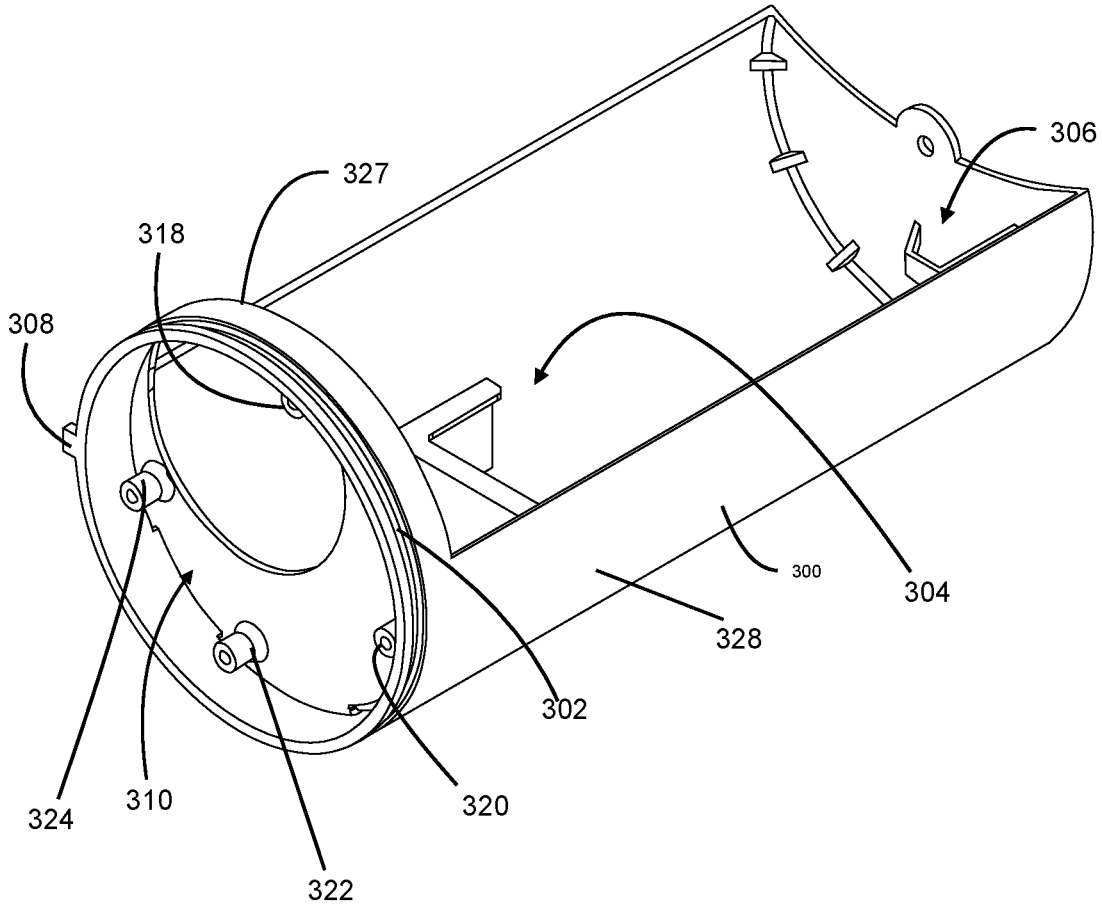
FIG. 6*g* shows a view of an embodiment of the inner housing of an embodiment of a razor caddy, as seen from the bottom-left side.
Figure 6H:
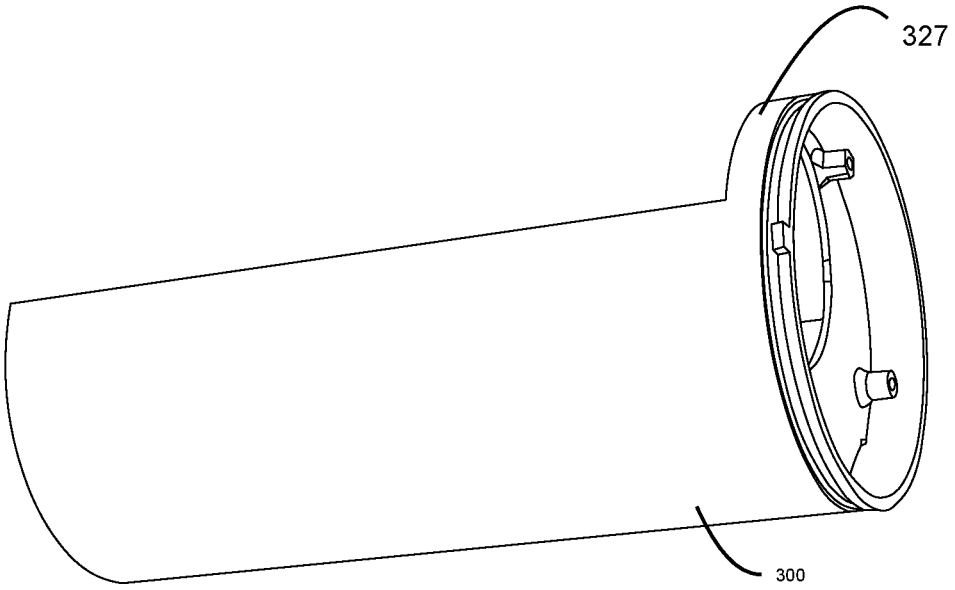
FIG. 6*h* shows a view of an embodiment of the inner housing of an embodiment of a razor caddy, as seen from the bottom-right side.

The inner housing 300 of the razor caddy assembly 100 may further have an interior surface and an exterior surface, the inner housing connector 302 (see FIG. 6*g*) may be disposed on the exterior surface of the inner housing 300 (the inner housing connector 302 may be flange, such as a rail; that may encircle some or all of the inner housing exterior; alternatively the inner housing connector 302 may be a channel-defining section that defines a channel space (for purposes of this disclosure and claim, the channel refers to the channel-defining section that defines a channel space); in the preferred embodiments the inner housing connector and the outer housing connector are detachably mateable such that when the inner housing connector may be a rail then the outer housing connector may be a channel such that the inner housing connector may be disposed within the outer housing connector and the outer housing connector may be configured to prevent or decrease the likelihood that the outer housing will be detached from the inner housing as the outer housing is rotated around the inner housing; alternatively, the outer housing connector may be a rail and the inner housing connector may be a channel). The inner housing 300 of the razor caddy assembly 100 may further have a floor 310 (see FIG. 7*b* for an embodiment of floor 310), the floor 310 may have a floor opening area 314 that may define an opening 312 of the floor 310 of the inner housing 300. The inner housing 300 of the razor caddy assembly 100 may further have a side wall 316 of the inner housing 300, a first fastener receiving member 318, a first fastener 102 (not shown in FIG. 6*g*), and a plate 400.

Figure 10A:
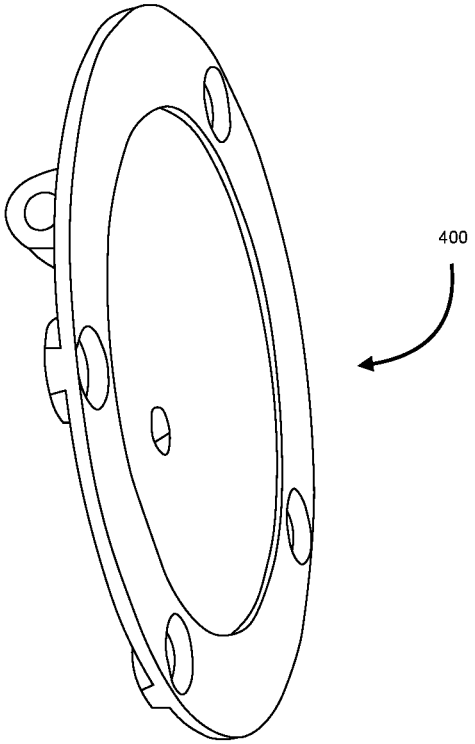
FIG. 10*a* shows a perspective view of an embodiment of a plate; the bottom side is shown.
Figure 10B:
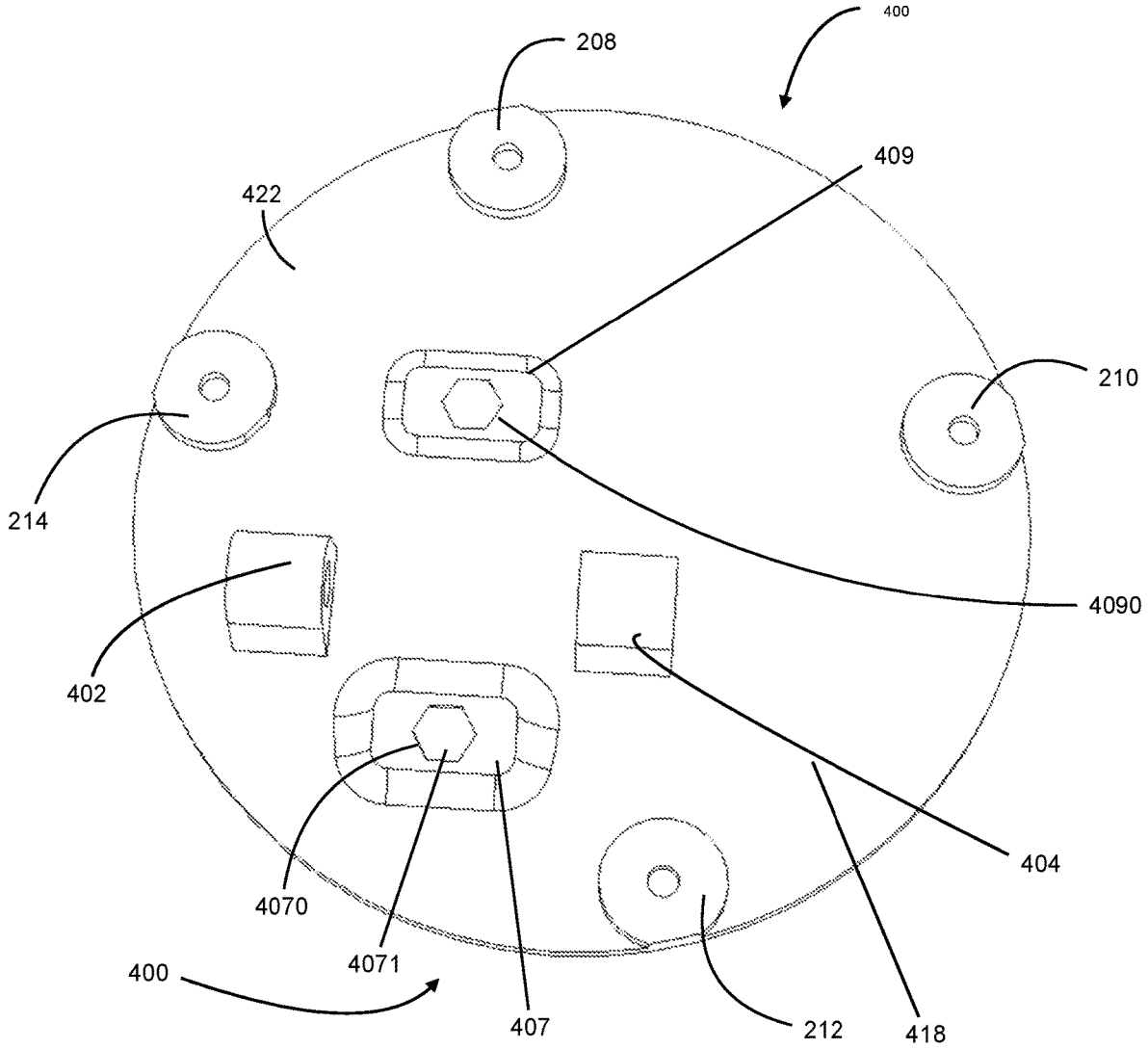
FIG. 10*b* shows the top side of an embodiment of a plate.
Figure 10C:
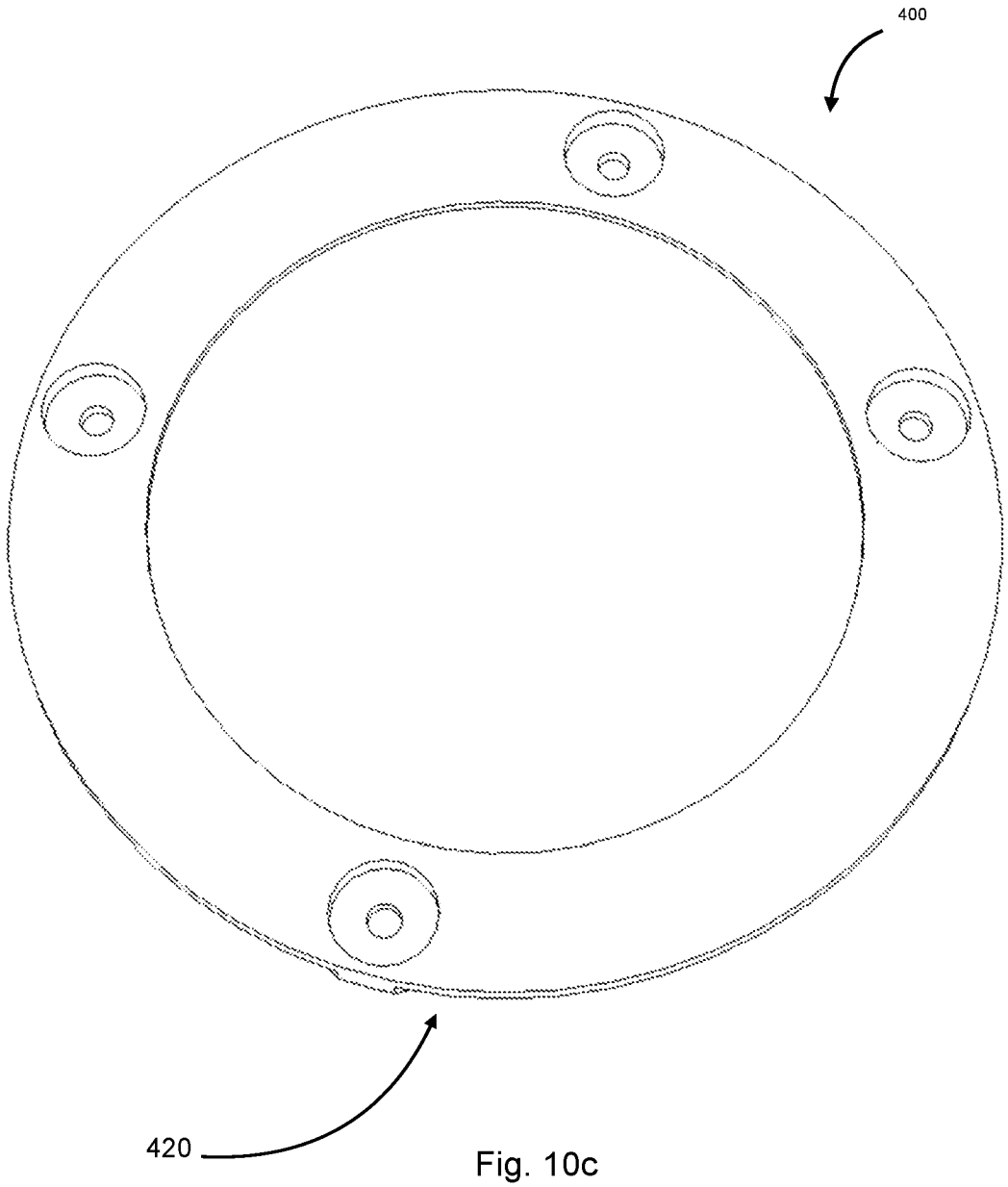
FIG. 10*c* shows the bottom side of an embodiment of a plate.
Figure 10D:
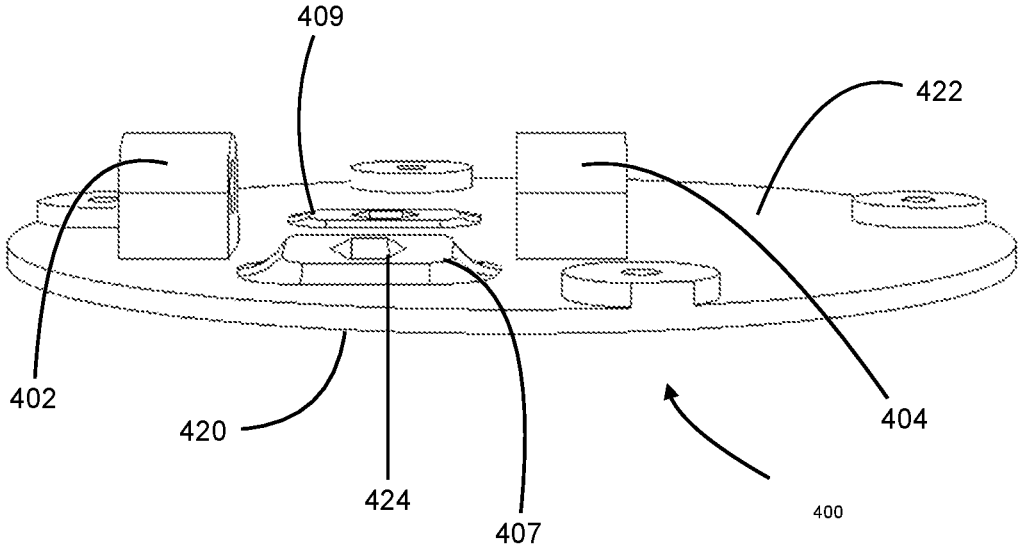
FIG. 10*d* shows the front side of an embodiment of a plate.
Figure 10E:
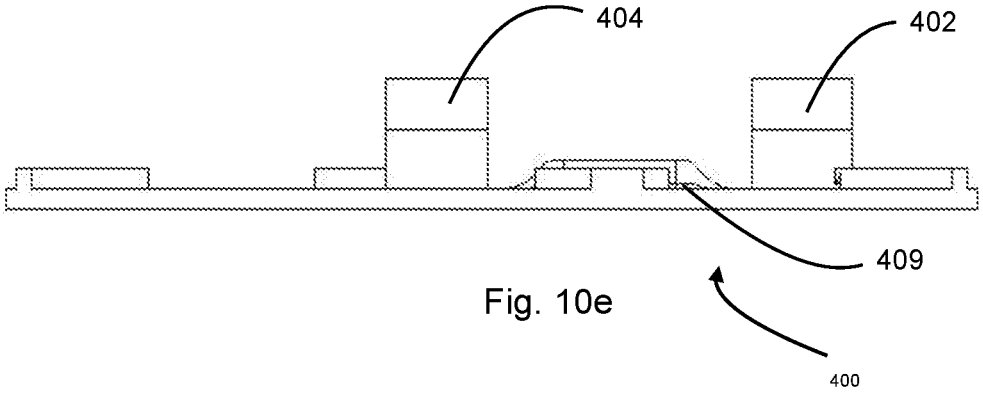
FIG. 10*e* shows the back side of an embodiment of a plate.
Figure 10F:
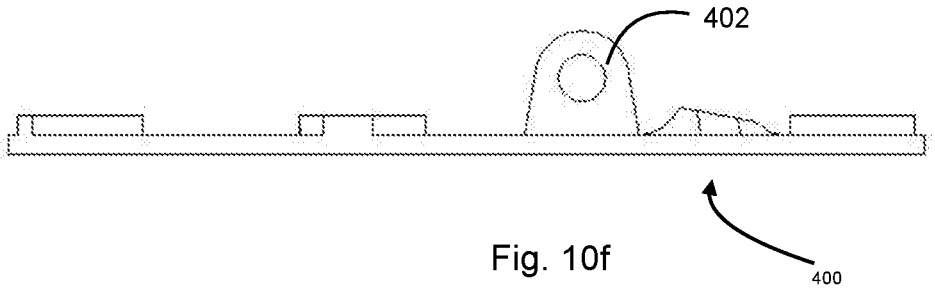
FIG. 10*f* shows the left side of an embodiment of a plate.
Figure 10G:
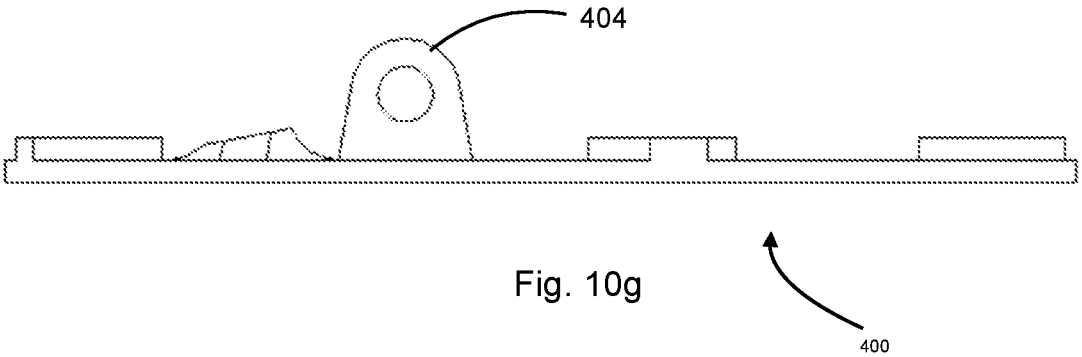
FIG. 10*g* shows the right half side of an embodiment of a plate.
Figure 11A:
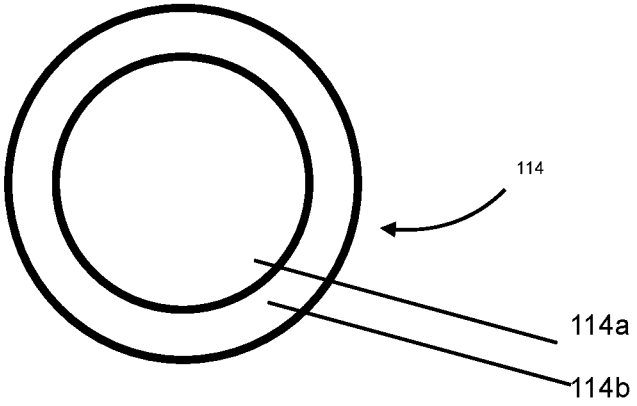
FIG. 11*a* shows a top view of an embodiment of the base.
Figure 11B:
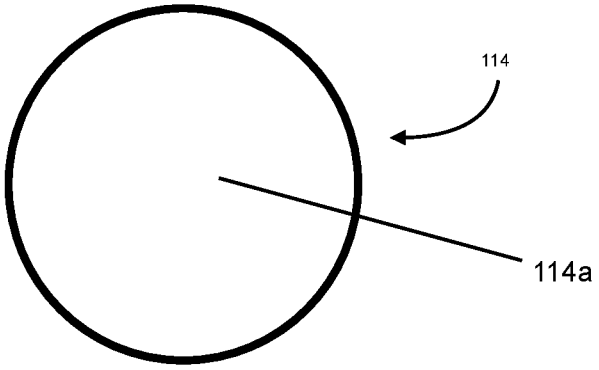
FIG. 11*b* shows a bottom view of an embodiment of the base.
Figure 11C:
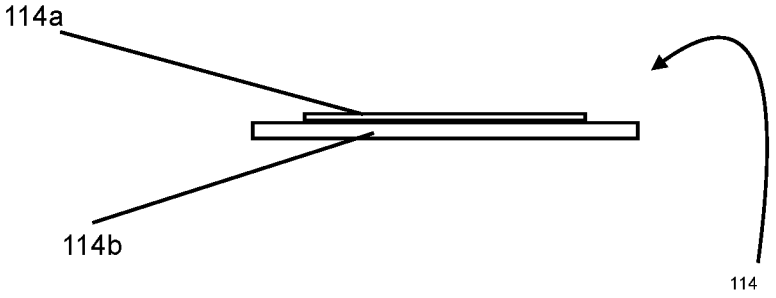
FIG. 11*c* shows a side view of an embodiment the base.
Figure 12:
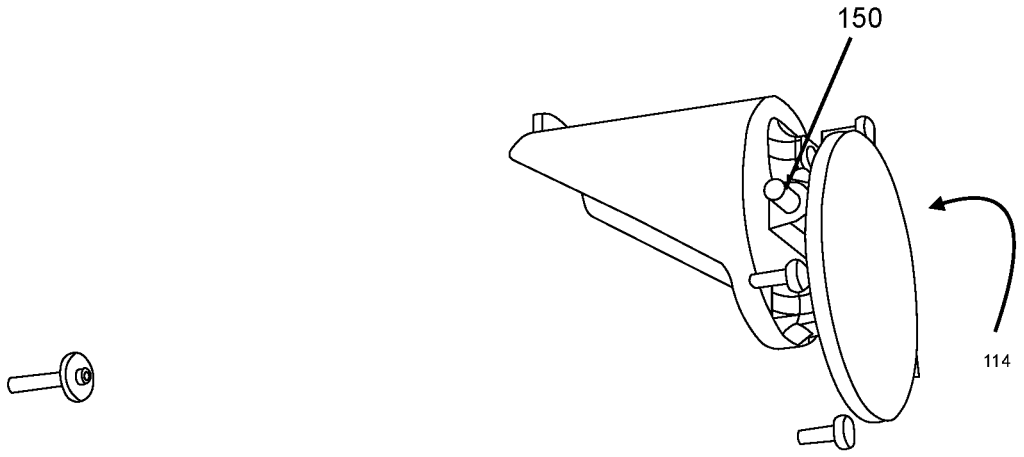
FIG. 12 shows a side view of the holster and the base without any plate
Figure 13:
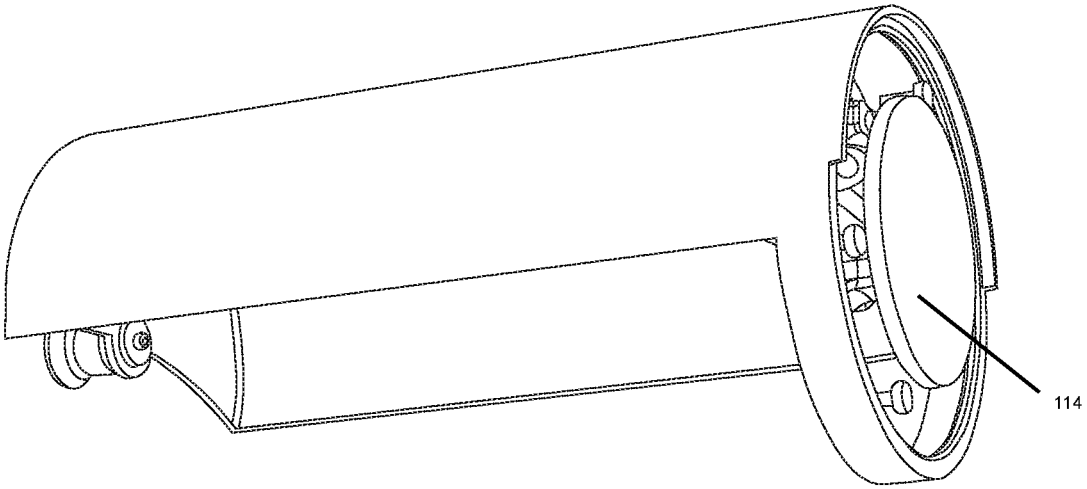
FIG. 13 shows the embodiment of FIG. 12 as disposed within an outer housing.

The first fastener 102 may be disposed within the first fastener receiving member 318. The first fastener receiving member 318 may extend from the floor 310 of the inner housing 300. Referring to FIG. 10*d*, the plate 400 may have an upper surface 418. A first pin receiving member 402 may be disposed on the upper surface 418 of the plate 400. The first pin receiving member 402 may be curved and may define an opening that may receive an end of a pin or spindle. The plate 400 may have a second pin receiving member 404 that may be disposed on the upper surface 418 of the plate 400. The plate 400 may have a lower surface 420. The third connecting member 407 of the plate 400 may be positioned to couple with the first connecting member 205 of the holster short leg 204 when the holster is forward-tilting. Third magnet holder 4070 may define an opening, such as a hexagonal opening, and the opening may be configured to receive a magnet or other object that is configured to detachably attach to another object. Referring to FIG. 10*b*, plate 400 may have a first fastener receiver 208, a second fastener receiver 210, a third fastener receiver 212, and a fourth fastener receiver 214.

Figure 2:
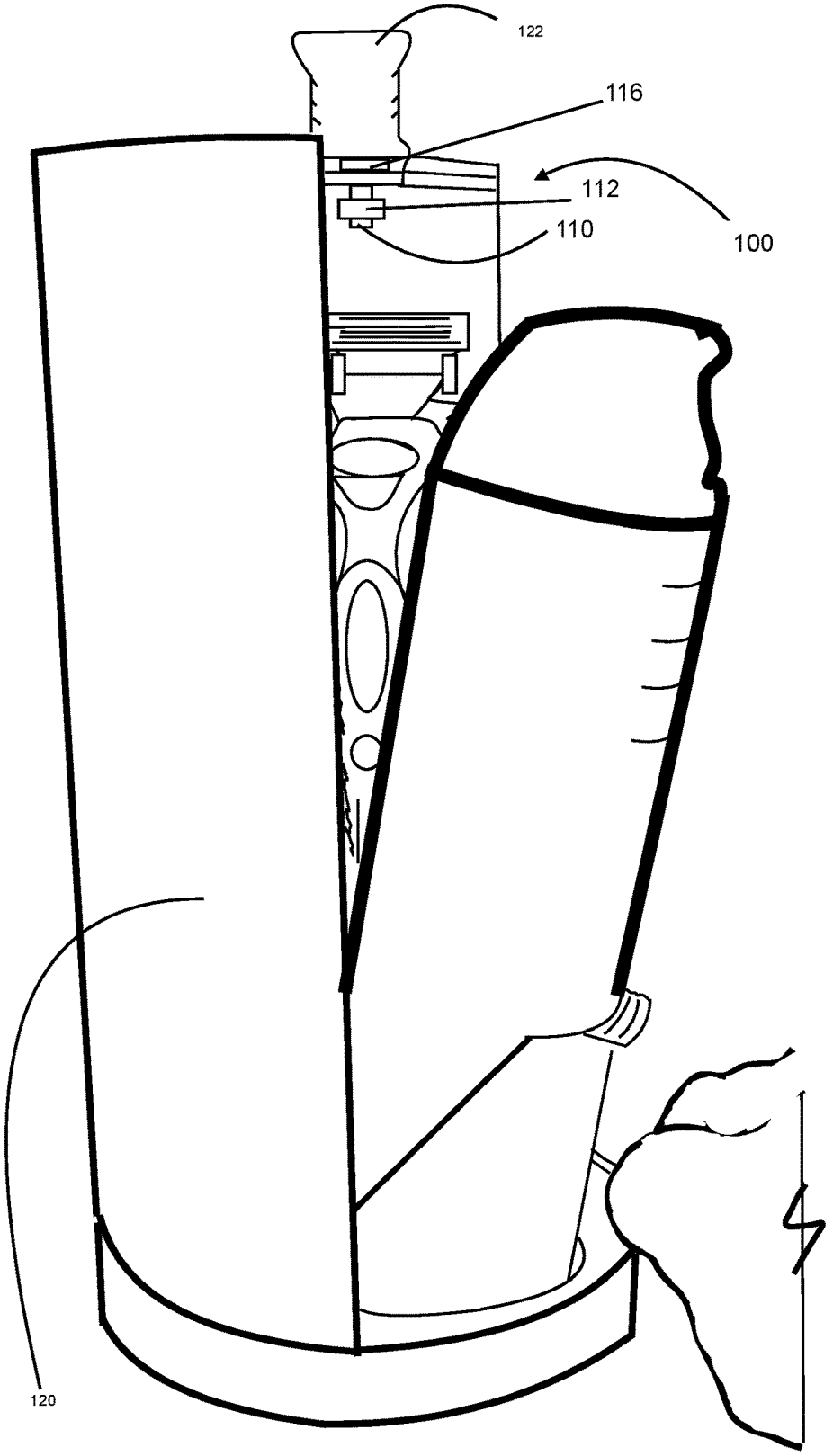
FIG. 2 shows a schematic of a razor caddy assembly that is in the open position; the holster has been tilted forward by a user.

The opening 128 (see FIG. 3 for a depiction of an embodiment) of the razor caddy assembly 100, may be defined by the lower rim 126*a* of the outer housing 120 and may be circular (see FIG. 5*h* which shows a portion of the lower rim 126*a* that is not bounded above or below by a sidewall; the remainder of the lower rim 126*a* is bounded above and below by a section of the sidewall); referring to FIG. 1*a*, the knob 122 may define a central opening of knob 122; referring to FIG. 2, the razor caddy assembly 100 may further have a knob fastener 110 and a nut 112 of the knob fastener 110 (the nut 112 may be coupled or integrally coupled to the outer housing; or it may be freestanding); the nut 112 of the knob fastener 110 may be disposed between the outer housing 120 and the inner housing 300; wherein at least a portion of the knob fastener 110 may be disposed within the central opening of the knob 122.

The razor caddy assembly 100 may also have an inner housing connector 302; the inner housing connector 302 may have a rail; the rail may substantially circumscribe the inner housing 300; wherein the outer housing connector 130 may have a channel; the channel of the outer housing connector 130 may substantially circumscribe the outer housing 120; the channel of the outer housing 120 may detachably engage said rail of the inner housing 300; the third connecting member 407 may be disposed on the plate 400, that may have a third magnet holder 4070, and the third connecting member 407 may be positioned an angle that is between 2 degrees and 60 degrees above the horizontal plane.

The inner housing connector 302 of the razor caddy assembly 100 may have a channel; the channel may substantially circumscribe the inner housing 300; and the outer housing connector 130 may have a rail; the rail of the outer housing connector 130 may substantially circumscribe the outer housing 120; the rail of the outer housing 120 may detachably engage said channel of the inner housing 300.

The razor caddy assembly 100 may further have a spacer 116, and the spacer 116 may be disposed between the outer housing 120 and the inner housing 300. Spacer 116 may be a washer and an embodiment is depicted in FIG. 2.

The razor caddy assembly 100 may further have a lower rim 301 of the inner housing 300, wherein a distance from the holster short leg 204 to the lower rim 301 (see FIG. 6*e* for a depiction of an embodiment) is less than a distance from the holster long leg to the lower rim 301 of the inner housing 300. When the holster is disposed so that the holster is coupled to the plate via a pin, then holster short leg 204 may be located closer to the edge when compared to holster long leg 206.

The razor caddy assembly 100 may include a main base 114 that is affixed to the plate 400. The affixing may be via glue, welding or other materials and methods. In FIG. 3, the main base 114 is shown in exploded view, in the preferred embodiments the main base is coupled to the plate such that the distance between the plate and the main base is not visible to the naked eye.

The main base 114 may further have an upper portion 114*a*, having a diameter, and a lower portion 114*b*, having a diameter; wherein the diameter of the upper portion 114*a* is less than the diameter of the lower portion 114*b*. The lower portion 114*b* may be circular; the upper portion 114*a* may be circular.

The inner housing may also have a blade rack 304, which may have one or more flanges that are configured to support one or more blades or one or more blade cartridges.

The inner housing may also have a razor rack 306; the razor rack 306 may have one or more prongs.

The razor caddy assembly 100 may further have a) a second fastener receiving member 320, the second fastener receiving member 320 may extend from the floor 310 of the inner housing 300, b) a third fastener receiving member 322, the third fastener receiving member 322 may extend from the floor 310 of the inner housing 300, c) a fourth fastener receiving member 324, the fourth fastener receiving member 324 may extend from the floor 310 of the inner housing 300.

Referring to FIG. 6*a*-6*h*, the inner housing 300 may further have a) a second fastener receiving member 320, the second fastener receiving member 320 may extend from the floor 310 (see FIG. 6*g* for a depiction of an embodiment) of the inner housing 300, b) a third fastener receiving member 322, the third fastener receiving member 322 may extend from the floor 310 of the inner housing 300, and c) a fourth fastener receiving member 324, the fourth fastener receiving member 324 may extend from the floor 310 of the inner housing 300 (a portion of any fastener receiving member may be depressed and form a depressed area, while the portion surrounding the depressed area may extend away from the depressed area).

The plate 400 may have a top surface 422, and the plate may further have a) a fifth fastener receiving member 410, the fifth fastener receiving member 410 may extend from the plate 400 towards the inner housing 300, b) a sixth fastener receiving member 412, the sixth fastener receiving member 412 may extend from the plate 400 towards the inner housing 300, c) a seventh fastener receiving member 414, the seventh fastener receiving member 414 may extend from the plate 400 towards the inner housing 300; and, d) an eighth fastener receiving member 416, the eighth fastener receiving member 416 may extend from the plate 400 towards the inner housing 300.

When the plate 400 is fastened to the inner housing 300 (see FIG. 7*c*), then the top surface 422 (see FIG. 10*d*) of the plate 400 may be at least ⅛ of an inch below the floor 310. In some embodiments, the first magnet holder 406*a* may be positioned at an angle that is between 5 degrees and 22 degrees above the horizontal.

A fastener may be disposed within a fastener receiving member, which may be threaded, such that when a fastener is disposed within the fastener receiving member, then the fastener is coupled to the fastener receiving member.

The razor caddy assembly 100 may have a blade rack 304 that may be disposed along an inner surface 303 of the inner housing 300. The razor caddy assembly 100 may also have a razor rack 306 that may be disposed along an inner surface 303 of the inner housing 300. The razor rack 306 may have an angled holder that may be configured to hold one or more blades or cartridges. The razor rack 306 may have a front portion and a back portion; the front portion may be angled. Coupled to or detachably coupled to the interior surface of the main wall may be a frame configured for one or more razor heads or spare blades.

Referring to FIG. 7*a*, a first drainage slot 426 and a second drainage slot 428 are disclosed.

Methods of using the razor caddy assembly may be used in combination of some or all of the parts which have been described.

A method of using a razor caddy assembly 100 is as follows: providing a razor caddy assembly, the razor caddy assembly comprising an outer housing 120 comprising a knob 122 (the outer housing 120 may be coupled via a knob fastener to the outer housing 120); the outer housing 120 comprising an outer housing connector 130; an inner housing 300 having a height; the inner housing 300 being disposed within the outer housing 120 and comprising an inner housing connector 302; the inner housing connector 302 being detachably coupled to the outer housing connector 130; a plate 400 comprising a top surface 422; the plate 400 being coupled to the inner housing 300; a holster 200 disposed within the inner housing onto a plate 400; the holster comprising a first magnet 205 and a second magnet 207; the plate 400 further comprising a third magnet and a fourth magnet; the holster being magnetically and detachably coupled to the third magnet or the fourth magnet of the plate 400; and, a main base 114.

A user may rotate the outer housing 120 so as to substantially expose the holster 200 of the inner housing 300; a user may then tilt the holster so as to cause the holster short leg 204 of the holster 200 to magnetically couple at an angle, with respect to the floor 218 of the holster 200, with the second magnet holder 408 comprising the fourth magnet 409 and positioned to receive the second magnet 207 of the holster long leg 206 of the plate 400. A user may then remove a shaving cream can disposed within the holster; a user may then remove a razor from the razor rack 304; a user may then return the shaving cream can to the holster.

A user may then return the razor to the razor rack. A user may then tilt the holster so as to cause the holster long leg to couple with, such as magnetically couple with, the receiving member of the plate that is positioned so as to magnetically couple with the holster long leg when the holster long leg is substantially or generally vertical; and, a user may rotate the outer housing so as to substantially veil or hide the inner surface of the inner housing with the outer housing.

The spindle 150 may be coupled to the holster 200; the spindle 150 may be disposed within the spindle holder 216 of the holster 200; the spindle holder 216 of the holster 200 may have a length that is at least fifty percent the length of the spindle 150.

The holster short leg 204 may further have a first magnet 205 of the holster short leg 204; the first magnet may be located at or near the bottom of the holster short leg 204; the holster long leg 206 may further have a second magnet 207 of the holster long leg 206; the second magnet may be located at or near the bottom of the holster short leg.

Fastener 204, fastener 106, and fastener 108 are disclosed in FIG. 3.

The invention claimed is:

1. A razor caddy assembly comprising an outer housing comprising a knob; the outer housing comprising an outer housing connector; the outer housing connector being disposed on an interior surface of the outer housing;

an inner housing having a height; the inner housing being disposed within the outer housing and comprising an inner housing connector; the inner housing connector being detachably coupled to the outer housing connector; the inner housing having a lower nm;

a plate comprising a top surface; the plate being coupled to the inner housing;

a holster disposed within the inner housing and onto the plate, the holster comprising a first connecting member; and a second connecting member;

the plate further comprising a third connecting member; and a fourth connecting member;

the first connecting member of the holster being magnetically, via at least one magnet coupled to the first connecting member or to the third connecting member, and detachably coupled to the third connecting member of the plate when the second connecting member of the holster is not coupled to the fourth connecting member of the plate; and, a main base, the main base coupled to the plate.

2. The razor caddy assembly of claim 1, wherein the razor caddy assembly further comprises
a spindle coupled to the holster;
the outer housing further comprising
a lower rim of the outer housing; the lower rim of the outer housing defining an opening, the outer housing having an interior surface, the lower rim comprising a circumference having a first length; and
a side wall of the outer housing; the side wall of the outer housing comprising
a bottom rim of the side wall of the outer housing, the bottom rim of the side wall of the outer housing defining an arc having a second length; the second length being less than the first length;
the holster further comprising
a first floor of the holster, the first floor of the holster having a main surface, the main surface having an area;
a spindle holder of the holster, the spindle holder of the holster having a third length;
a holster grip;
a holster short leg;
a holster long leg;
a first fastener receiver;
the inner housing further comprising
an interior surface;
an exterior surface, the inner housing connector being disposed on the exterior surface of the inner housing;
a stopper having a fourth length, the stopper being disposed on the exterior surface of the inner housing; and
a second floor, the second floor comprising a floor opening area defining an opening of the second floor of the inner housing;
a side wall of the inner housing;
a first fastener receiving member, the first fastener receiving member extending from the second floor of the inner housing;
a first fastener disposed within the first fastener receiving member; and
the plate, being the same plate as referred to in claim 1, further comprising
an upper surface;
a first pin receiving member disposed on the upper surface of the plate;
a second pin receiving member being disposed on the upper surface of the plate; and
a lower surface, wherein the third connecting member is positioned to detachably couple with the first connecting member of the holster short leg when the holster is forward-tilting such that
a first magnet of the first connecting member is coupled to a third connecting member;
wherein the third connecting member comprises an inclined plane,
wherein the fourth connecting member is positioned to detachably couple the second connecting member of the holster long leg.

3. The razor caddy assembly of claim 2, wherein
the opening defined by the lower rim of the outer housing is circular;
the knob of the outer housing defining a central opening of the knob; and
the razor caddy assembly further comprises
a knob fastener; and
a nut of the knob fastener,
the nut of the knob fastener being disposed between the outer housing and the inner housing; and
at least one portion of the knob fastener being disposed within the central opening of the knob.

4. The razor caddy assembly of claim 3 further comprising a spacer, the spacer being disposed between the outer housing and the inner housing.

5. The razor caddy assembly of claim 4 further comprising a lower rim of the inner housing, wherein a distance from the holster short leg to the lower rim is less than a distance from the holster long leg to the lower rim of the inner housing.

6. The razor caddy assembly of claim 5, wherein the main base is affixed to the plate.

7. The razor caddy assembly of claim 6, wherein the main base further comprises
an upper portion, having a first diameter; and
a lower portion, having a second diameter; wherein the first diameter is less than the second diameter.

8. The razor caddy assembly of claim 7, wherein
the spindle coupled to the holster is disposed within the spindle holder of the holster; and wherein
the spindle holder of the holster has a length that is at least fifty percent the length of the spindle coupled to the holster.

9. The razor caddy assembly of claim 8, wherein
the holster short leg further comprises a first magnet of the holster short leg; and
wherein the holster long leg further comprises a second magnet of the holster long leg.

10. The razor caddy assembly of claim 9, wherein the fourth length of the stopper extends substantially along the length of the inner housing.

11. The razor caddy assembly of claim 10, wherein the inner housing further comprises
a second fastener receiving member, the second fastener receiving member extending from the floor of the inner housing;
a third fastener receiving member, the third fastener receiving member extending from the floor of the inner housing; and
a fourth fastener receiving member, the fourth fastener receiving member extending from the floor of the inner housing;
wherein the inner housing further comprises a blade rack; and,
wherein the inner housing further comprises a razor rack.

12. The razor caddy assembly of claim 10, wherein the razor caddy assembly further comprises
a second fastener receiving member, the second fastener receiving member extending from the floor of the inner housing;
a third fastener receiving member, the third fastener receiving member extending from the floor of the inner housing; and,
a fourth fastener receiving member, the fourth fastener receiving member extending from the floor of the inner housing.

13. The razor caddy assembly of claim 12, wherein
the plate has a top surface; the plate further comprises
a fifth fastener receiving member, the fifth fastener receiving member extending from the plate towards the inner housing;
a sixth fastener receiving member, the sixth fastener receiving member extending from the plate towards the inner housing;

a seventh fastener receiving member, the seventh fastener receiving member extending from the plate towards the inner housing; and, an eighth fastener receiving member, the eighth fastener receiving member extending from the plate towards the inner housing.

14. The razor caddy assembly of claim 13, wherein the top surface of the plate, when fastened to the inner housing, is at least ⅛ of an inch below the first floor; and the first magnet holder is positioned at an angle that is between 2 degrees and 40 degrees.

15. The razor caddy assembly of claim 14, wherein the second fastener is disposed among a third fastener and a fourth fastener.

16. The razor caddy assembly of claim 15, wherein the blade rack is disposed along an inner surface of the inner housing and the razor rack is disposed along an inner surface of the inner housing.

17. The razor caddy assembly of claim 2, wherein the inner housing connector comprises a rail, the rail substantially circumscribing the inner housing;

wherein the outer housing connector comprises a channel; the channel of the outer housing connector substantially circumscribing the outer housing;

the channel of the outer housing detachably engaging the rail of the inner housing connector; and the first magnet holder being positioned at an angle that is between 2 degrees and 60 degrees.

18. The razor caddy assembly of claim 2, wherein the inner housing connector further comprises a channel, the channel substantially circumscribing the inner housing;

the outer housing connector further comprises a rail; the rail of the outer housing connector substantially circumscribing the outer housing; and the rail of the outer housing connector detachably engaging the channel of the inner housing.

19. A method of using a razor caddy assembly comprising providing a razor caddy assembly, the razor caddy assembly further comprising an outer housing comprising a knob; the outer housing comprising an outer housing connector;

an inner housing having a height; the inner housing being disposed within the outer housing; the inner housing comprising an inner housing connector; the inner housing connector being detachably coupled to the outer housing connector;

a plate comprising a top surface; the plate being coupled to the inner housing;

a holster disposed within the inner housing onto a plate; the holster comprising a first connecting member and a second connecting member;

the plate further comprising a third connecting member; and a fourth connecting member;

the holster being magnetically and detachably coupled, via a magnet of the first connecting member, to the third connecting member of the plate; and, a main base;

rotating the outer housing along the rail so as to substantially expose the holster of the inner housing;

tilting the holster so as to cause a magnet of a magnet holder disposed at a bottom end of the second connecting member of the holster short leg to magnetically couple at an angle between 5 degrees and 40 degrees, with respect to a floor of the holster, with the fourth connecting member of the plate.

* * * * *